US011167567B2

(12) United States Patent
Ueno

(10) Patent No.: US 11,167,567 B2
(45) Date of Patent: Nov. 9, 2021

(54) PRINTING DEVICE

(71) Applicant: Ricoh Company, Ltd., Tokyo (JP)

(72) Inventor: Satoshi Ueno, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/817,462

(22) Filed: Mar. 12, 2020

(65) Prior Publication Data

US 2020/0290370 A1 Sep. 17, 2020

(30) Foreign Application Priority Data

Mar. 15, 2019 (JP) ..... JP2019-048112

(51) Int. Cl.
*B41J 3/407* (2006.01)
*B41J 2/01* (2006.01)
(Continued)

(52) U.S. Cl.
CPC ..... *B41J 3/4078* (2013.01); *B41J 2/01* (2013.01); *B41J 3/4073* (2013.01); *B41J 11/002* (2013.01); *B41J 11/02* (2013.01)

(58) Field of Classification Search
CPC . B41J 3/4078; B41J 2/01; B41J 11/002; B41J 11/02; B41J 3/4073; B41J 11/20;
(Continued)

(56) References Cited

U.S. PATENT DOCUMENTS 5,879,091 A * 3/1999 De Ambrogio ..... B41J 11/20 400/656
7,699,419 B2 * 4/2010 Lin ..... B41J 29/02 347/8
(Continued)

FOREIGN PATENT DOCUMENTS

JP H08-192545 7/1996
JP 2001-191596 7/2001
(Continued)

OTHER PUBLICATIONS

Machine translation of JP 2005-138332, published on Jun. 2005 (Year: 2005).*
(Continued)

*Primary Examiner* — Huan H Tran
(74) *Attorney, Agent, or Firm* — Xsensus LLP

(57) ABSTRACT

A printing device includes a medium holding portion a medium holding portion on which a medium is placed, a discharge unit, a holding portion, a first displacement mechanism, a second displacement mechanism, and a contacting portion of the medium holding portion. The discharge unit is configured to discharge an object to the medium placed on the medium holding portion. The holding portion is configured to hold the discharge unit. The first displacement mechanism is configured to displace a relative position of the medium and the discharge unit along a placement surface of the medium. The second displacement mechanism is configured to displace the medium holding portion along a height direction. The contacting portion configured to come in contact with a contacted portion located at a surface of the medium holding portion, the medium placed on the surface.

14 Claims, 20 Drawing Sheets

(51) Int. Cl.
*B41J 11/00* (2006.01)
*B41J 11/02* (2006.01)

(58) Field of Classification Search
CPC ..... B41J 11/06; B41J 25/308; B41J 25/3082; B41J 25/3084
See application file for complete search history.

(56) References Cited

U.S. PATENT DOCUMENTS

| | | | | |
|---|---|---|---|---|
| 9,387,688 | B2 * | 7/2016 | Sugiyama | B41J 2/45 |
| 10,889,136 | B2 * | 1/2021 | Kunioka | B41J 3/4078 |
| 2004/0247508 | A1 * | 12/2004 | Sakurai | A62D 3/36 423/240 R |
| 2007/0071532 | A1 * | 3/2007 | Ho | B41J 11/04 400/649 |
| 2007/0247508 | A1 * | 10/2007 | Miura | B41J 11/20 347/102 |
| 2009/0211404 | A1 * | 8/2009 | Pedersen | E21B 19/168 81/57.16 |
| 2010/0013877 | A1 * | 1/2010 | Haraguchi | B41J 11/0085 347/8 |
| 2014/0028746 | A1 * | 1/2014 | Chen | B41J 11/20 347/8 |
| 2016/0375706 | A1 * | 12/2016 | Kimoto | B41J 2/125 347/8 |
| 2017/0320316 | A1 * | 11/2017 | Nakamura | B41J 11/06 |
| 2017/0320339 | A1 * | 11/2017 | Matsumoto | B41J 11/002 |
| 2018/0147858 | A1 * | 5/2018 | Kunioka | D06P 5/00 |
| 2018/0154656 | A1 * | 6/2018 | Ueno | B41J 3/4078 |
| 2018/0154858 | A1 * | 6/2018 | Aranzulla | B60R 21/233 |
| 2018/0170087 | A1 * | 6/2018 | Kobayashi | B41M 7/009 |
| 2018/0313033 | A1 * | 11/2018 | Yanase | B41F 15/12 |
| 2020/0101769 | A1 * | 4/2020 | Kunioka | B41J 11/002 |
| 2020/0298591 | A1 * | 9/2020 | Ueno | B41J 11/06 |

FOREIGN PATENT DOCUMENTS

| | | |
|---|---|---|
| JP | 2002-192779 | 7/2002 |
| JP | 2005-138332 | 6/2005 |
| JP | 2016-020550 | 2/2016 |
| JP | 2016-107474 | 6/2016 |
| JP | 2016-108699 | 6/2016 |
| JP | 2016-108701 | 6/2016 |
| JP | 2017-209873 | 11/2017 |
| JP | 2017-223916 | 12/2017 |

OTHER PUBLICATIONS

Machine translation of JP 202192779, published on Jul. 2002 (Year: 2002).*

Machine translation of JP 2001191596, published on Jul. 2001 (Year: 2001).*

* cited by examiner

PRINTING DEVICE

CROSS-REFERENCE TO RELATED APPLICATIONS

The present application claims priority under 35 U.S.C. § 119 to Japanese Patent Application No. 2019-048112, filed on Mar. 15, 2019. The contents of which are incorporated herein by reference in their entirety.

BACKGROUND OF THE INVENTION

1. Field of the Invention

The present invention relates to a printing device.

2. Description of the Related Art

In printing devices such as inkjet printers, technologies for adjusting a gap formed between a head that discharges ink and a medium to be an object of printing have been utilized.

For example, in Japanese Unexamined Patent Application Publication No. 2005-138332, disclosed is a recording device including a spring that pushes up a platen from below and supports it and a caster that is fixed to the head and restricts an upper limit of the height of the platen. The relevant recording device includes, for the purpose of enabling the upper limit of the height of the platen to be adjusted while maintaining the spring force of the spring, a unit to adjust, with respect to the head, the heights of the lower end of the spring and of the caster.

In Japanese Unexamined Patent Application Publication No. 2002-192779, disclosed is a recording device including a unit that elastically supports a platen by using a spring and displaces the platen in the thickness direction according to the thickness of the medium. The relevant recording device includes, for the purpose of enabling the recording start position to be determined well, a gap adjustment roller provided on a head, and a unit to determine, based on a conducting state between a conductive portion provided on the platen and the roller, the presence of a medium between the head and the platen.

As in the above-described conventional technologies, by providing a member (caster and roller) for adjusting the gap on the head, the stabilization of the gap in a main-scanning direction of the head can be achieved. If a component such as the platen has skew or distortion, variations in the gap arise along a sub-scanning direction. Such variations in the gap may, even if the skew or the distortion of the component is slight, end up being relatively large as a whole in the sub-scan direction. Such a problem is not possible to be solved sufficiently by the conventional technologies.

SUMMARY OF THE INVENTION

According to an aspect of the present invention, a printing device includes a medium holding portion a medium holding portion on which a medium is placed, a discharge unit, a holding portion, a first displacement mechanism, a second displacement mechanism, and a contacting portion of the medium holding portion. The discharge unit is configured to discharge an object to the medium placed on the medium holding portion. The holding portion is configured to hold the discharge unit. The first displacement mechanism is configured to displace a relative position of the medium and the discharge unit along a placement surface of the medium. The second displacement mechanism is configured to displace the medium holding portion along a height direction. The contacting portion configured to come in contact with a contacted portion located at a surface of the medium holding portion, the medium placed on the surface.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
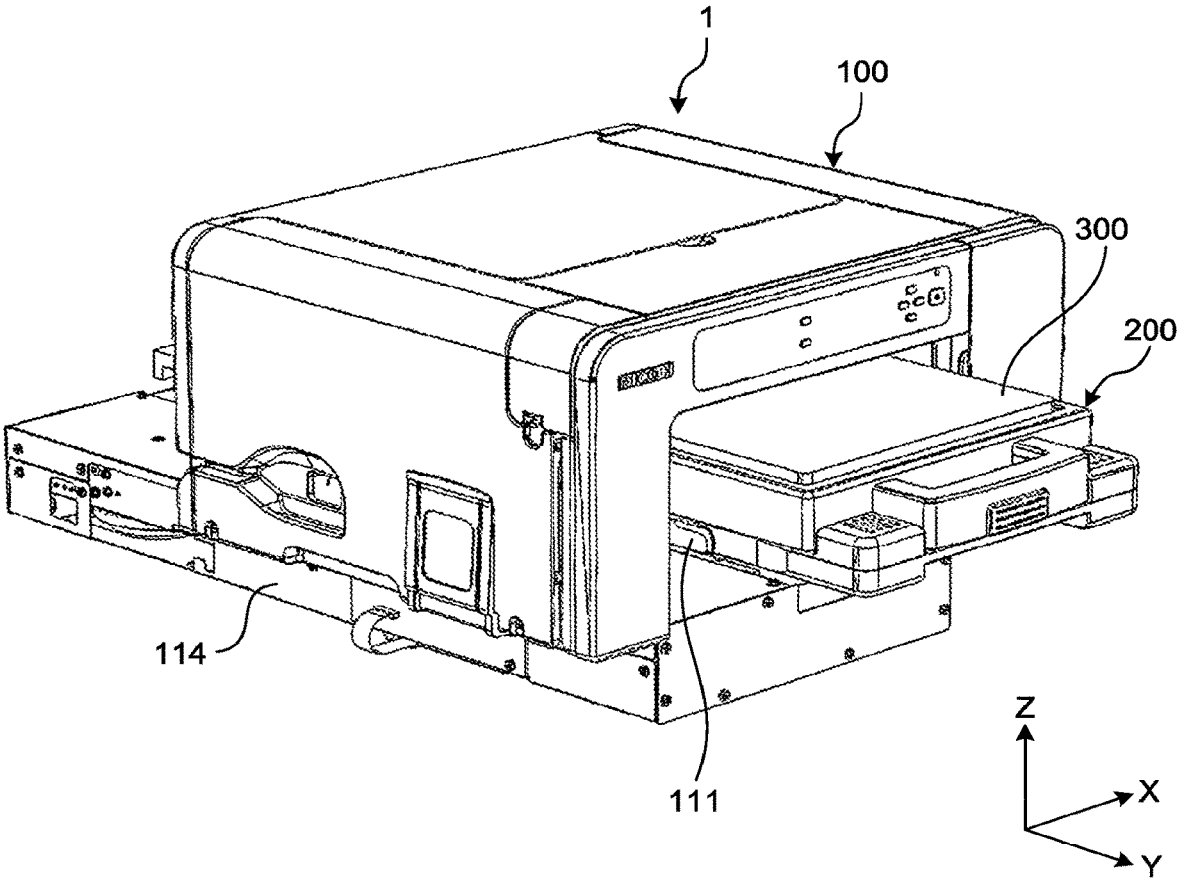
FIG. 1 is a perspective view illustrating one example of an appearance configuration of a printing device according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to improve the stability of the gap

With reference to the accompanying drawings, the following describes in detail exemplary embodiments of a printing device.

First Embodiment

Figure 2:
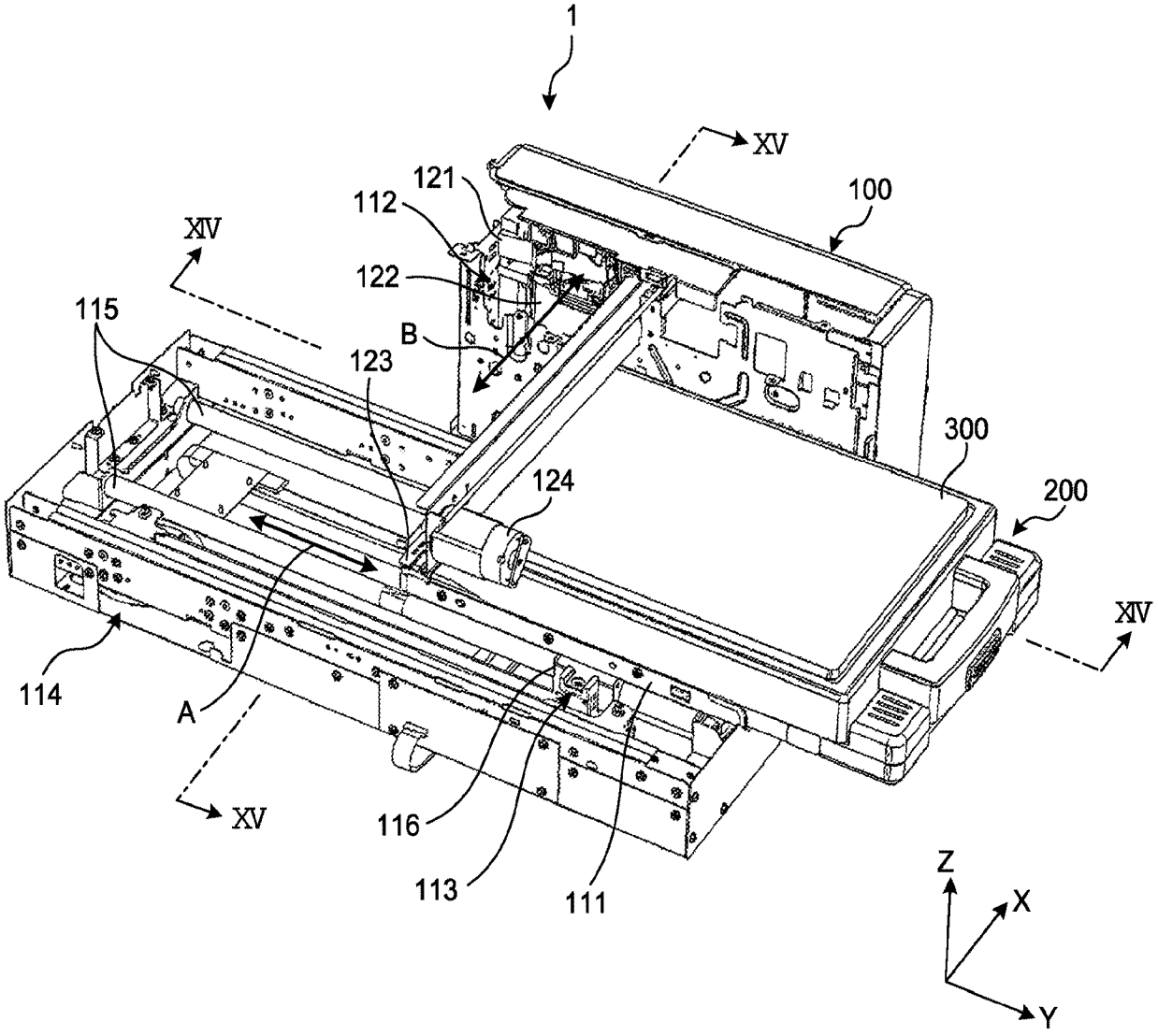
FIG. 2 is a perspective view illustrating one example of an internal configuration of the printing device in the first embodiment.
Figure 3:
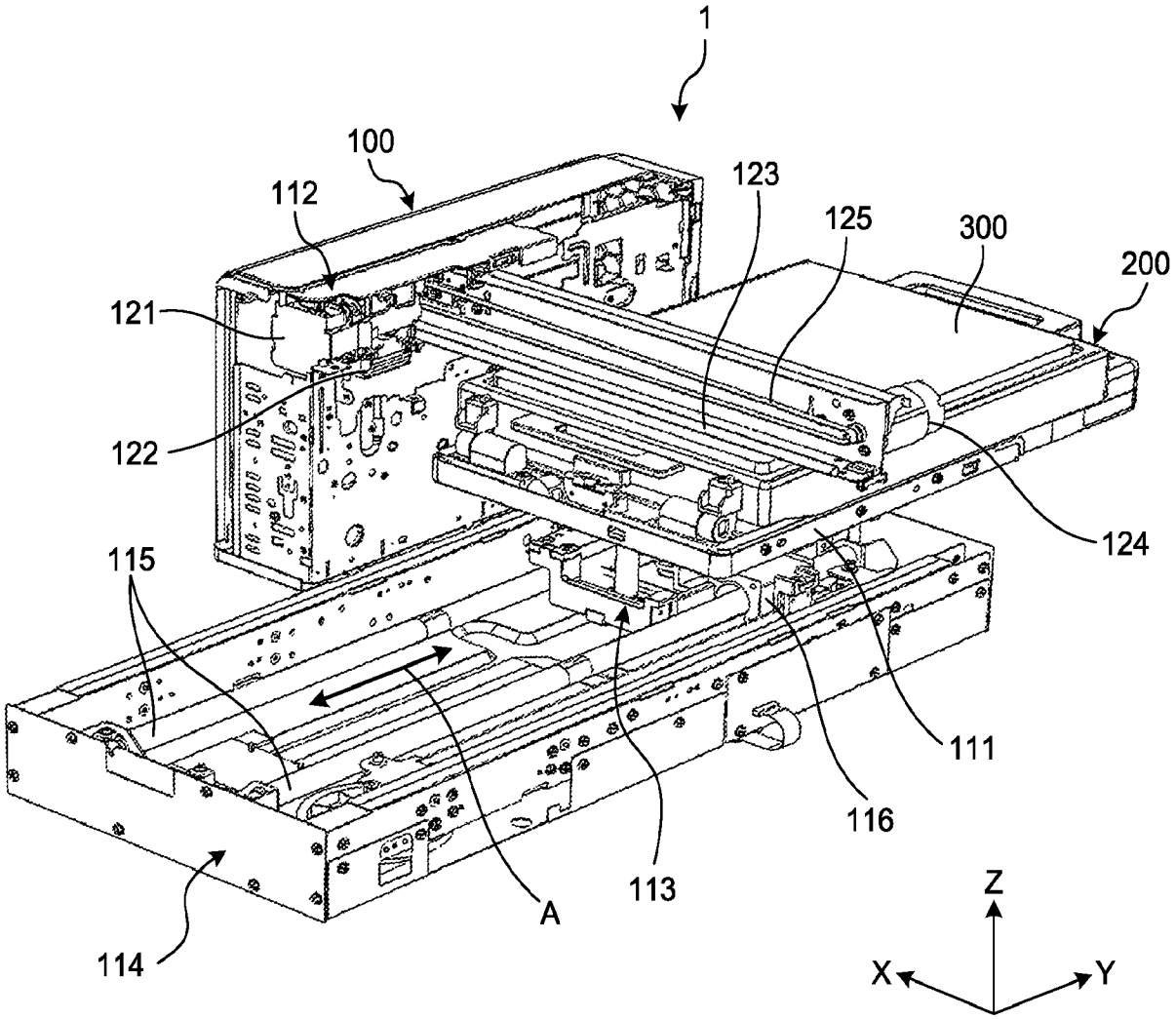
FIG. 3 is a perspective view illustrating one example of the internal configuration of the printing device in the first embodiment.

In FIG. 1 to FIG. 3, one example of an overall configuration of a printing device 1 according to a first embodiment is illustrated. In this case, as one example of a "printing device", the printing device 1 constituting a device (textile printer) that provides an image on fabric will be exemplified.

FIG. 1 is a perspective view illustrating one example of an appearance configuration of the printing device 1 in the first embodiment. FIG. 2 and FIG. 3 are perspective views illustrating one example of the internal configuration of the printing device 1 in the first embodiment. FIG. 2 and FIG. 3 have depiction angles that differ from each other. In the drawings, an X-axis is an axis in parallel with a main-scanning direction, a Y-axis is an axis in parallel with a sub-scanning direction, and a Z-axis is an axis in parallel with a height direction.

The printing device 1 includes a stage 111 and a printing unit 112 in a device body 100. The stage 111 is a member that detachably holds a cassette 200 holding fabric 400 (see FIG. 6) and that moves back and forth. The fabric 400 is one example of a "medium" to be an object of printing. The printing unit 112 prints on the fabric 400 that is held to the cassette 200 held to the stage 111.

The stage 111 is provided on a conveyance structure 113 that is held movably in an arrow A direction (the sub-scanning direction) with respect to the device body 100. The stage 111 that is a placement surface of the fabric 400 and the conveyance structure 113 are one example of a "first displacement mechanism" that changes the relative position of the printing unit 112 and the fabric 400 in a displacement direction (in the first embodiment, the sub-scanning direction) along the stage 111. Conveyance guide members 115 are arranged along the arrow A direction on a bottom housing portion 114 of the device body 100. Slide members 116 of the conveyance structure 113 are movably held by the conveyance guide members 115.

The printing unit 112 includes a carriage 121 that moves in an arrow B direction (the main-scanning direction) with respect to the stage 111 and a head 122 that is fitted to the carriage 121. The carriage 121 and the head 122 are one example of a "discharge unit" that discharges ink and the like to the fabric 400. The carriage 121 is movably held by a guide member 123 that is arranged along the arrow B direction, and is reciprocally moved in the arrow B direction via a scanning mechanism such as a timing belt 125 and the like by a drive motor 124. The guide member 123 is one example of a "holding portion" that holds the carriage 121 (including the head 122). The head 122 is a member that discharges liquid such as ink and the like on the surface of the fabric 400. The ink is one example of an "object" that is discharged from the head 122. In the first embodiment, the ink capable of textile printing on the fabric 400 is used. However, the specific configuration of the head 122 and the type of the object discharged from the head 122 are not particularly limited.

When performing printing, first, in a state in which the fabric 400 is set to the cassette 200, the cassette 200 is attached to the stage 111 in the device body 100 and held. Then, by repeating the reciprocal move of the head 122 in the arrow B direction (the main-scanning direction) and the move of the stage 111 in the arrow A direction (the sub-scanning direction), a desired image is printed on the fabric 400.

Figure 4:
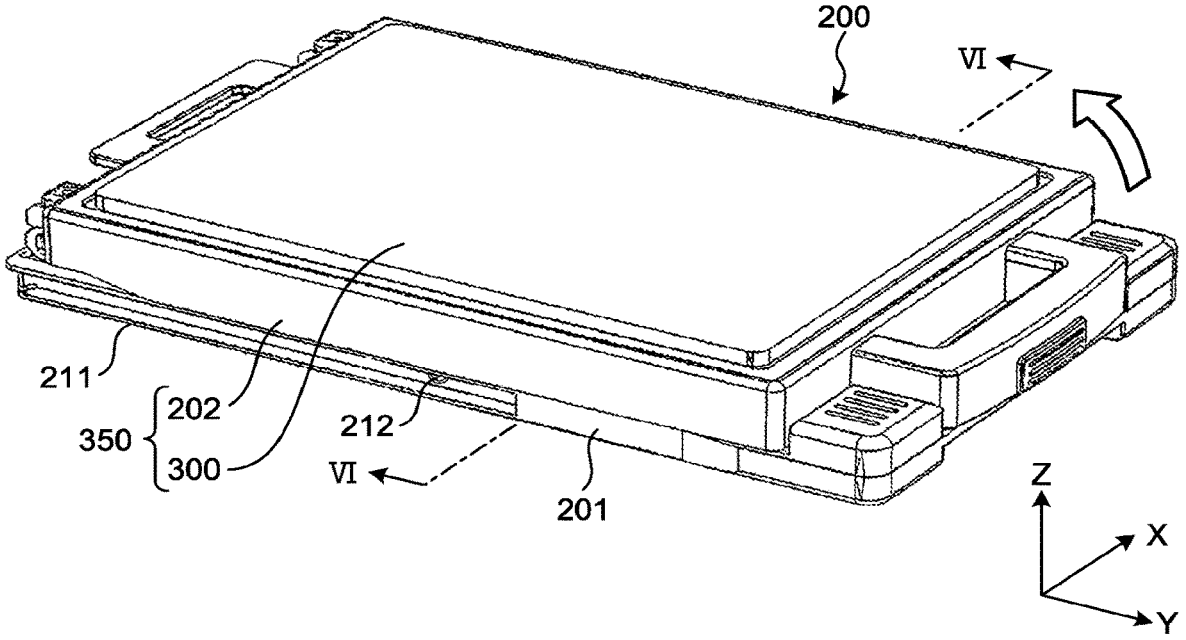
FIG. 4 is a perspective view illustrating one example of the appearance configuration of a cassette in the first embodiment.
Figure 5:
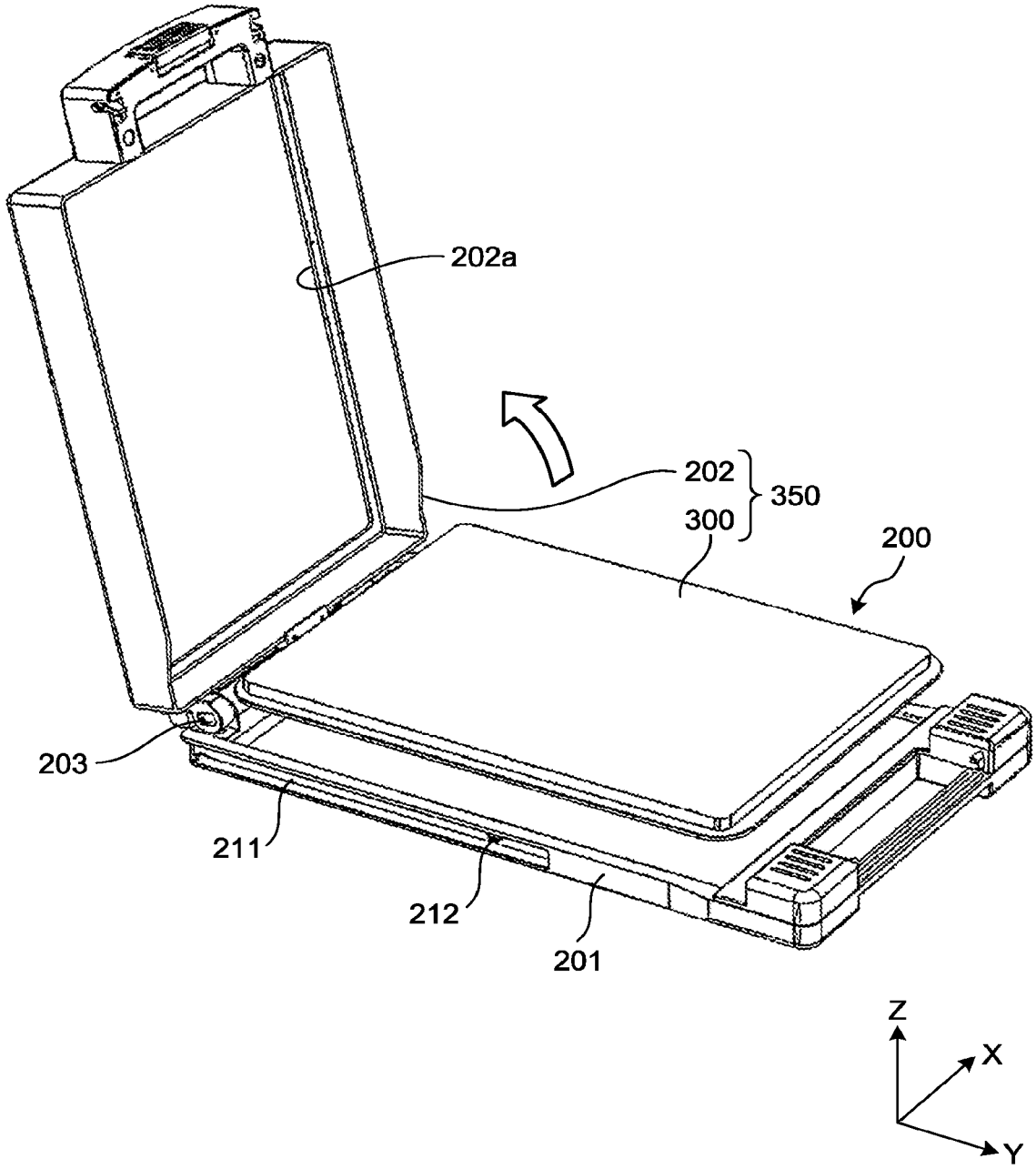
FIG. 5 is a perspective view illustrating one example of the cassette in an opened state of an outer peripheral cover in the first embodiment.
Figure 6:
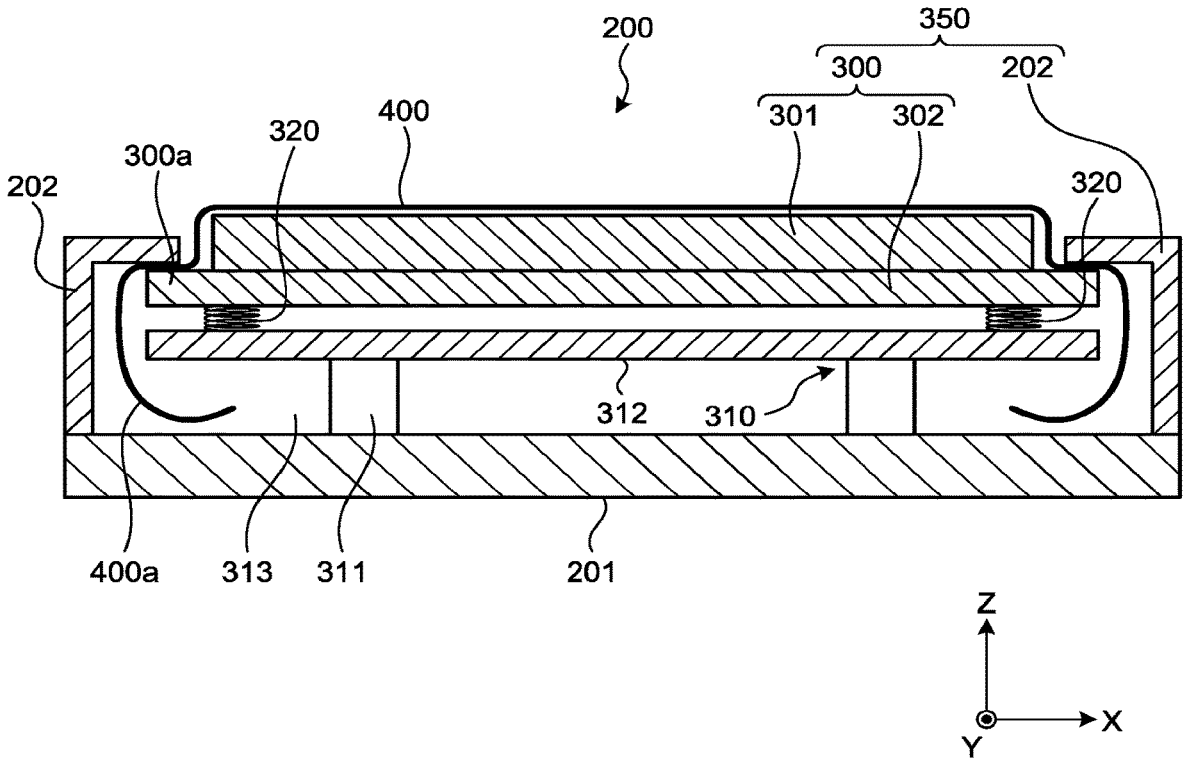
FIG. 6 is a cross-sectional view viewed along the line VI-VI in FIG. 4 illustrating one example of a cross-sectional shape of the cassette in the first embodiment.

The following describes the configuration example of the cassette 200 with reference to FIG. 4 to FIG. 6. FIG. 4 is a perspective view illustrating one example of the appearance configuration of the cassette 200 in the first embodiment. FIG. 5 is a perspective view illustrating one example of the cassette 200 in an opened state of an outer peripheral cover 202 in the first embodiment. FIG. 6 is a cross-sectional view viewed along the line VI-VI in FIG. 4 illustrating one example of a cross-sectional shape of the cassette 200 in the first embodiment. In FIG. 6, for the sake of description convenience, the fabric 400 is depicted that is not depicted in FIG. 4.

The cassette 200 includes a cassette base 201, a platen member 300, an elevating mechanism 310, and springs 320. The platen member 300 is one example of a "placement portion" on which the fabric 400 is to be placed, and constitutes a medium holding portion 350 together with the outer peripheral cover 202 which will be described later. The elevating mechanism 310 is one example of a "second displacement mechanism" that displaces the platen member 300 along the height direction. "Height direction" is a direction toward the printing unit 112 (the carriage 121) from the platen member 300, and in the first embodiment, is a direction in parallel with an up-and-down direction (the vertical direction). In the present disclosure, the direction that the platen member 300 gets closer to the carriage 121 may be expressed as "up", and the direction that the platen member 300 gets away from the carriage 121 may be expressed as "down". The spring 320 is one example of an "elasticity portion" that biases the platen member 300 upward.

The platen member 300 includes a heat-insulating member 301 and a platen structure body 302.

The heat-insulating member 301 constitutes a surface that holds the fabric 400 in a flat state and has heat resistance against heating by a fixing device 5 (see FIG. 11) which will be described later. As the material of the heat-insulating member 301, heat-resistant sponge rubber, various heat-resistant resins, felt, calcium silicate plate, Kalhon, Kallyte, plaster board, melamine sponge, glass wool, glass, and the like are available. The heat-resistant sponge rubber and various heat-resistant resins can be formed of the material such as silicone rubber, fluororubber and the like.

Because the platen structure body 302 needs hardness in order to maintain the flatness of the platen member 300 and a certain degree of heat resistance, a metal plate, a glass plate, and the like are suitably used.

The heat-insulating member 301 and the platen structure body 302 may be made up of a single component.

On the cassette base 201, the outer peripheral cover 202 is provided so as to be opened and closed via hinges 203. The outer peripheral cover 202 is one example of a "fixing portion" that fixes the fabric 400 to the platen member 300 and constitutes the medium holding portion 350 together with the platen member 300. The outer peripheral cover 202 has an opening 202*a* at the portion corresponding to the platen member 300 (the heat-insulating member 301). The fabric 400 is held by being sandwiched between a flange portion 300*a* on the peripheral portion of the platen member 300 (the platen structure body 302) and the outer peripheral cover 202. As the fabric 400 is sandwiched between the flange portion 300*a* and the outer peripheral cover 202 in this manner, the outer peripheral cover 202 presses the fabric 400 in the height direction.

The fabric 400 is not only the fabric formed with a single piece of fabric such as handkerchiefs and towels but may also be the fabric made into clothing such as T-shirts and trainers, the fabric constituting a part of products such as tote bags, or the like.

The elevating mechanism 310 includes drive shafts 311 and a work (elevating portion) 312. The drive shafts 311 receive predetermined driving force of an electric motor and the like and are displaced in the up-and-down direction. The work 312 is a plate-like member horizontally fixed on the upper-end portion of the drive shafts 311 and is displaced in the up-and-down direction along with the displacement of the drive shafts 311. The control method of driving force that displaces the drive shafts 311 (the work 312) is not particularly limited.

The springs 320 are interposed between the work 312 and the platen member 300. The spring 320 biases the platen member 300 upward. In addition, the spring 320 absorbs an excess portion of the pressure exerted with respect to the platen member 300 from the upside or an excess portion of the pressure exerted with respect to the platen member 300 from the lower side.

Between the platen member 300 and the cassette base 201, an accommodating space 313 capable of accommodating an excess portion 400*a* of the fabric 400 is formed. The excess portion 400*a* corresponds to both sleeves, collar, bottom, and the like, in the case of providing an image on the front face of a T-shirt, for example.

The platen member 300 in the first embodiment is detachable from the cassette base 201 and is formed so as to be replaceable. As a result, by preparing a plurality of platen members 300 and keeping the clothing wrapped on another platen member 300 while in print operation, the printing of the next fabric can be started promptly by merely replacing the platen member 300 after finishing the printing and fixing.

When setting the fabric 400 to the cassette 200 having the above-described configuration, as illustrated in FIG. 5, the outer peripheral cover 202 is opened first and the fabric 400 is placed on the platen member 300. Thereafter, as illustrated in FIG. 6, in a state in which the excess portion 400*a* of the fabric 400 is accommodated in the accommodating space 313, the outer peripheral cover 202 is closed as illustrated in FIG. 4. Note that the fabric 400 does not necessarily need to be fixed by the outer peripheral cover 202. For example, for the fabric 400 the size of which is smaller than the area of the heat-insulating member 301, the relevant fabric 400 may be in a state of being simply placed on the heat-insulating member 301.

When printing an image on the fabric 400, as illustrated in FIG. 1, the cassette 200 is attached onto the stage 111 of the device body 100 of the printing device 1.

As just described, according to the above-described configuration, because the fabric 400 that is an object of printing can be set onto the platen member 300 in a state in which the cassette 200 is removed from the device body 100, setting work of the fabric 400 to the platen member 300 is facilitated.

Figure 7:
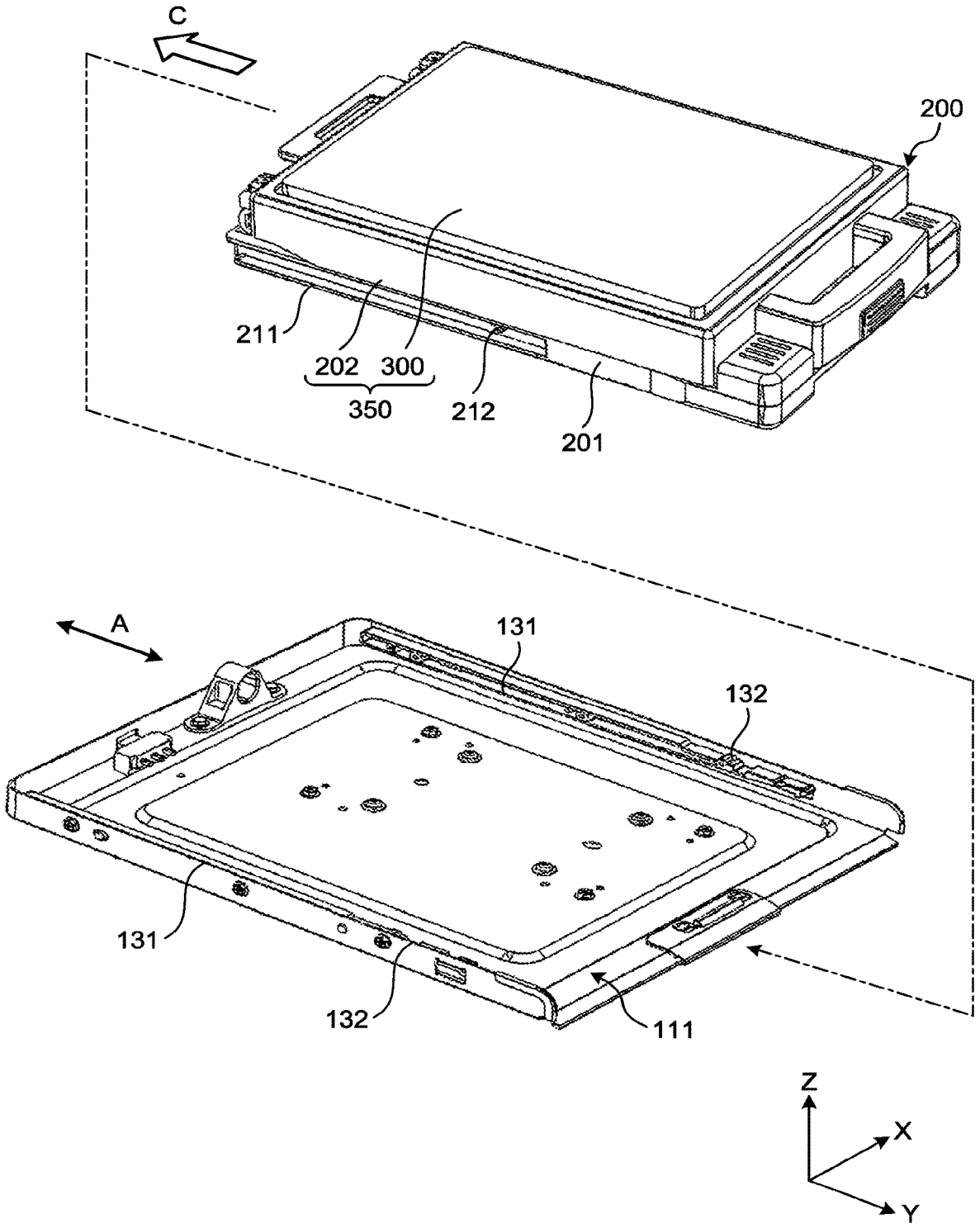
FIG. 7 is a perspective view illustrating one example of the configuration of a stage and the cassette in the first embodiment.
Figure 8:
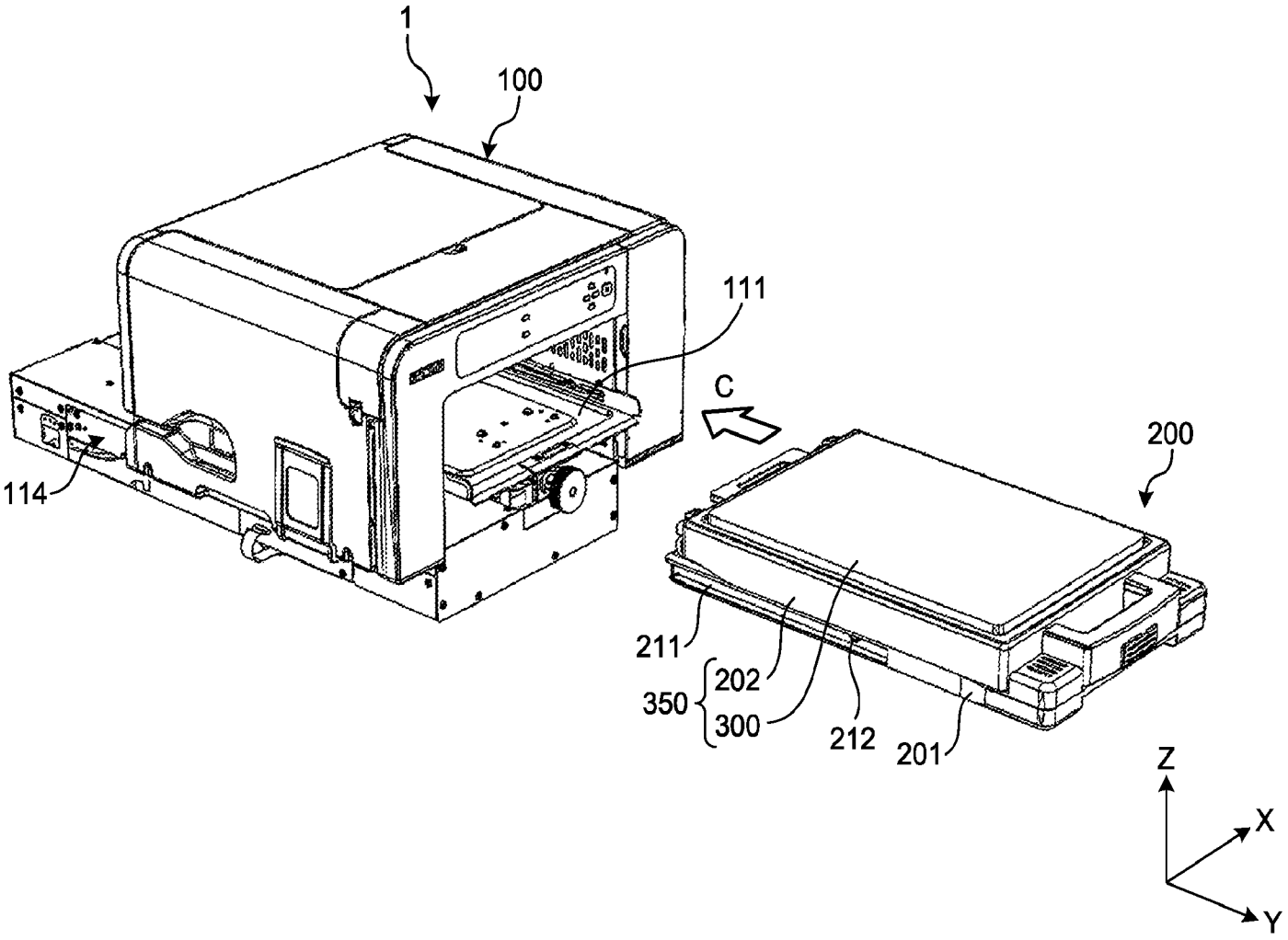
FIG. 8 is a perspective view illustrating one example of a state of attaching the cassette to a device body in the first embodiment.
Figure 9:
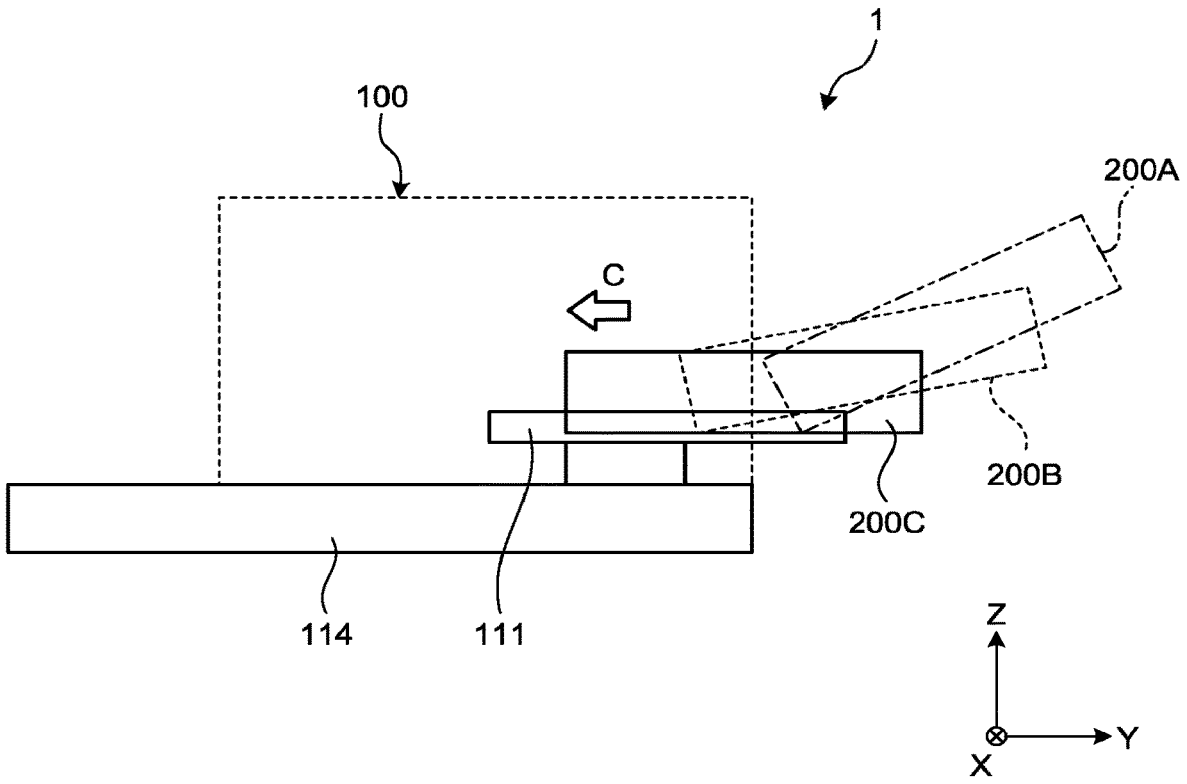
FIG. 9 is a schematic view illustrating one example of a state of attaching the cassette to the device body in the first embodiment.

Next, a configuration example for attaching the cassette 200 to the device body 100 will be described with reference to FIG. 7 to FIG. 9. FIG. 7 is a perspective view illustrating one example of the configuration of the stage 111 and the cassette 200 in the first embodiment. FIG. 8 is a perspective view illustrating one example of a state of attaching the cassette 200 to the device body 100 in the first embodiment. FIG. 9 is a schematic view illustrating one example of a state of attaching the cassette 200 (200A, 200B, 200C) to the device body 100 in the first embodiment.

On both side portions in the direction orthogonal to the arrow A direction (the sub-scanning direction) of the stage 111 of the device body 100, guide rail portions 131 are provided. On both side portions of the cassette 200, groove portions 211 to which the guide rail portions 131 are fitted in so as to be movable (slidable) are provided.

On both sides in the direction orthogonal to the arrow A direction of the stage 111, recessed shape portions 132 are provided. The position of the recessed shape portion 132 in the arrow A direction corresponds to the moving-end position (sliding-end position) of the guide rail portion 131 and the groove portion 211. On the cassette 200, protruded shape portions 212 that fit in the recessed shape portions 132 of the stage 111 are provided.

The guide rail portions 131, the groove portions 211, the recessed shape portions 132, the protruded shape portions 212, and the like constitute a "coupling mechanism" that detachably couples the stage 111 and the cassette 200 (including the platen member 300).

When attaching the cassette 200 to the stage 111 of the device body 100, as illustrated in FIG. 8, it only needs to slide the cassette 200 on the stage 111 along an arrow C direction that is the direction along the moving direction (the arrow A direction) of the stage 111.

In FIG. 9, the attaching procedure of the cassette 200 at such time is illustrated. First, as in the cassette 200A indicated by a long-dashed double-dotted line, the front end portion of the cassette 200 is placed on the stage 111. Thereafter, as in the cassette 200B indicated by a broken line, the cassette 200 is pushed in by sliding in the arrow C direction while making the groove portions 211 of the cassette 200 fit in the guide rail portions 131 of the stage 111. Then, as in the cassette 200C indicated by a solid line, the cassette 200 is pushed in up to the end position and, by making the protruded shape portions 212 of the cassette 200 fit in the recessed shape portions 132 of the stage 111, attaching of the cassette 200 is completed.

According to the above-described configuration, the cassette 200 can be attached to the stage 111 along the moving direction of the stage 111. As a result, the entire stage 111 no longer needs to be exposed outside of the device body 100, at the time of attaching the cassette 200, as in the configuration for which the cassette 200 is attached to the stage 111 from directly above the stage 111.

Figure 10:
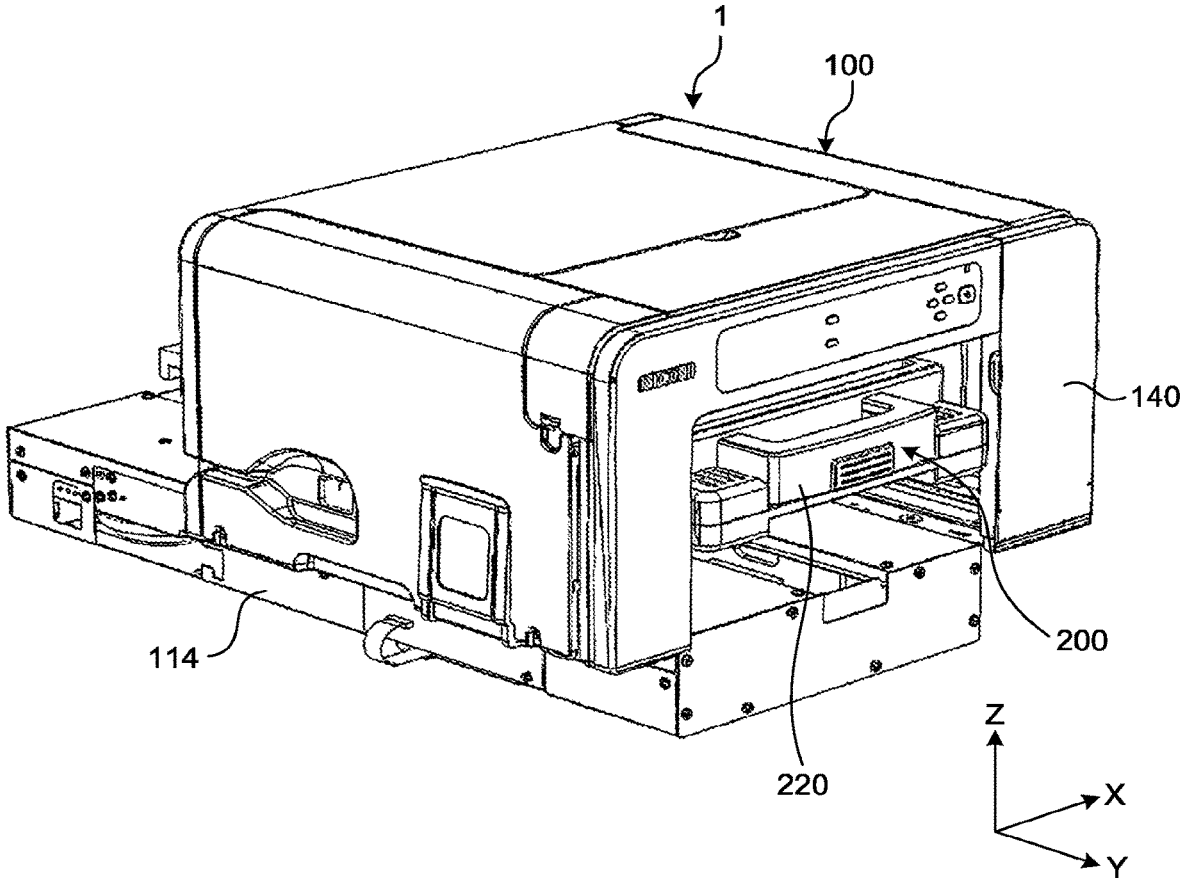
FIG. 10 is a perspective view illustrating one example of a power-off state of the printing device in the first embodiment.

Next, a state in which the cassette 200 is attached to the device body 100 and in which the power is turned off will be described with reference to FIG. 10. FIG. 10 is a perspective view illustrating one example of a power-off state of the printing device 1 in the first embodiment.

When a command to turn the device body 100 into a power-off state is received, as illustrated in FIG. 10, the stage 111 is moved so that a front face 220 of the cassette 200 and a front face 140 of the device body 100 are substantially in the same position in planar view. As a result, the installation space during standby can be made small.

Figure 11:
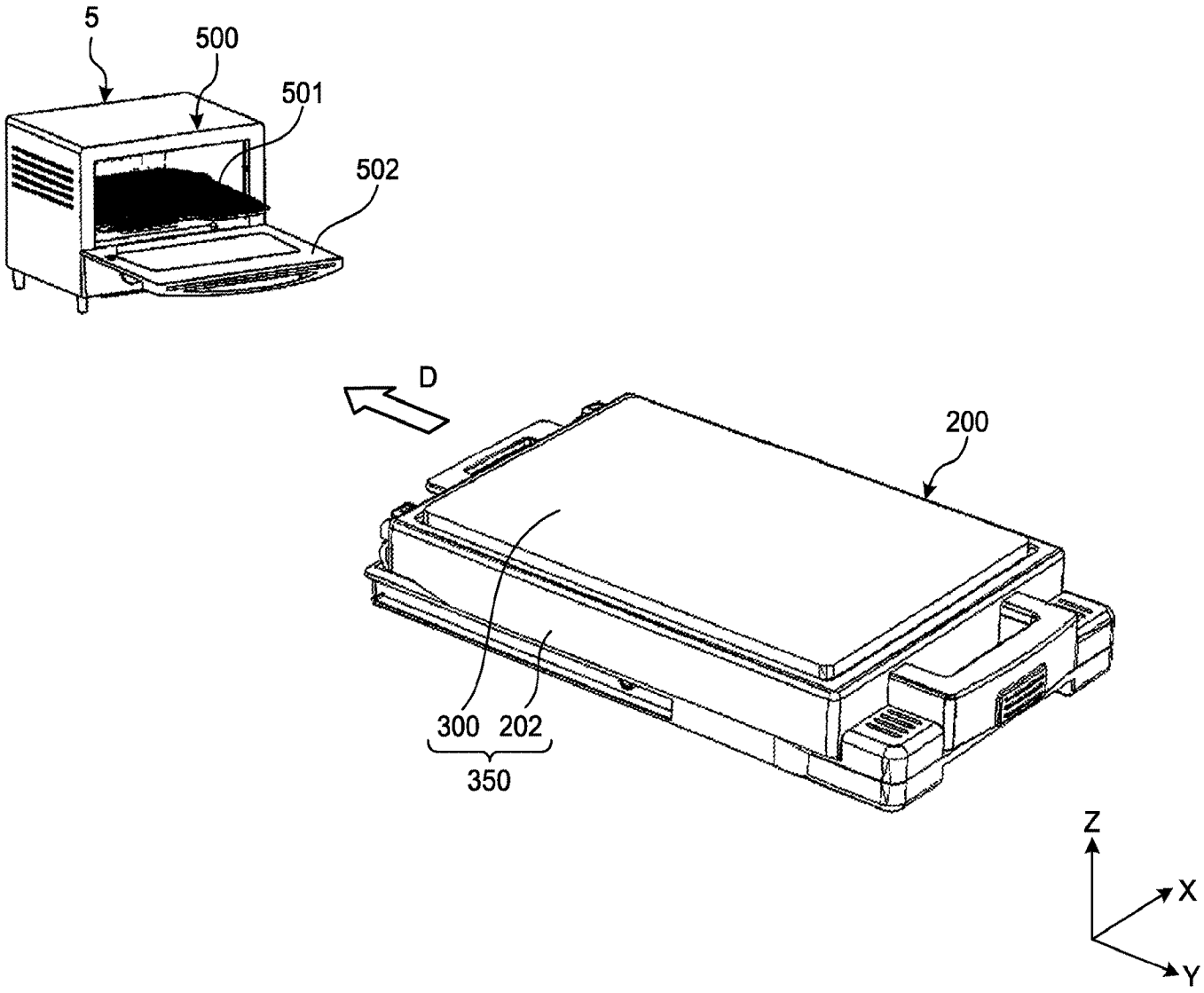
FIG. 11 is a perspective view illustrating one example of the appearance configuration of a fixing device and the cassette in the first embodiment.
Figure 12:
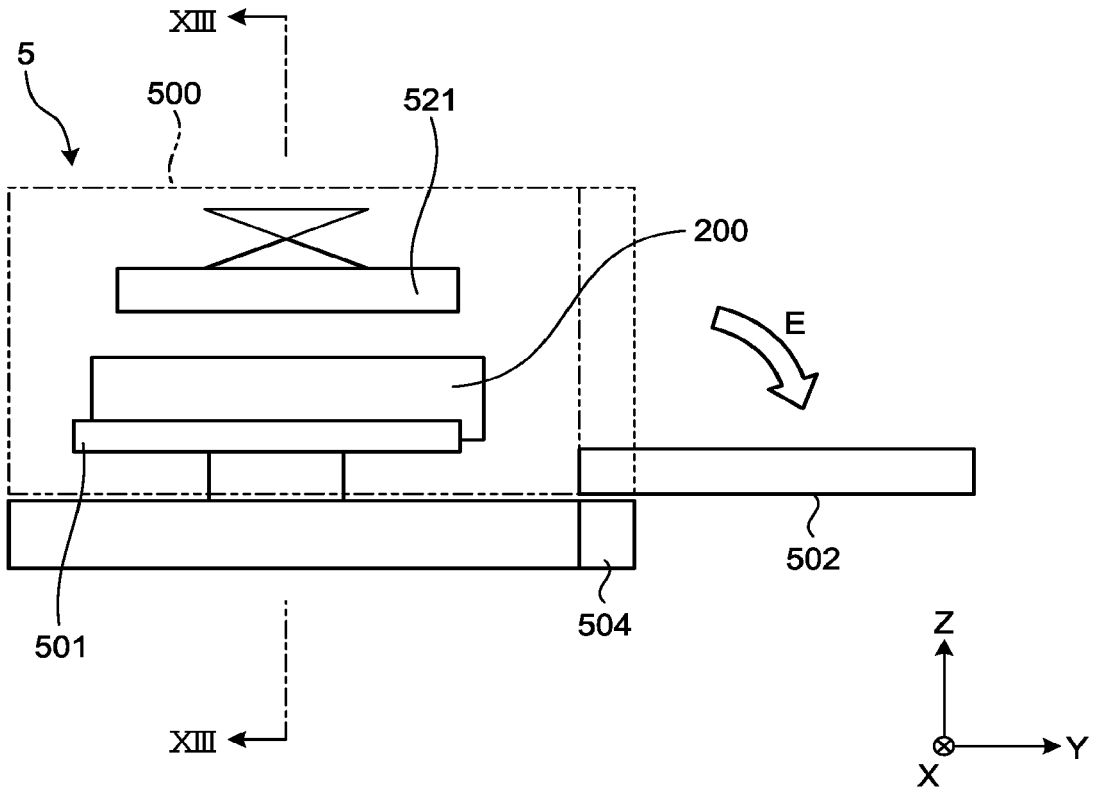
FIG. 12 is a schematic diagram illustrating one example of the internal configuration of the fixing device in the first embodiment.
Figure 13:
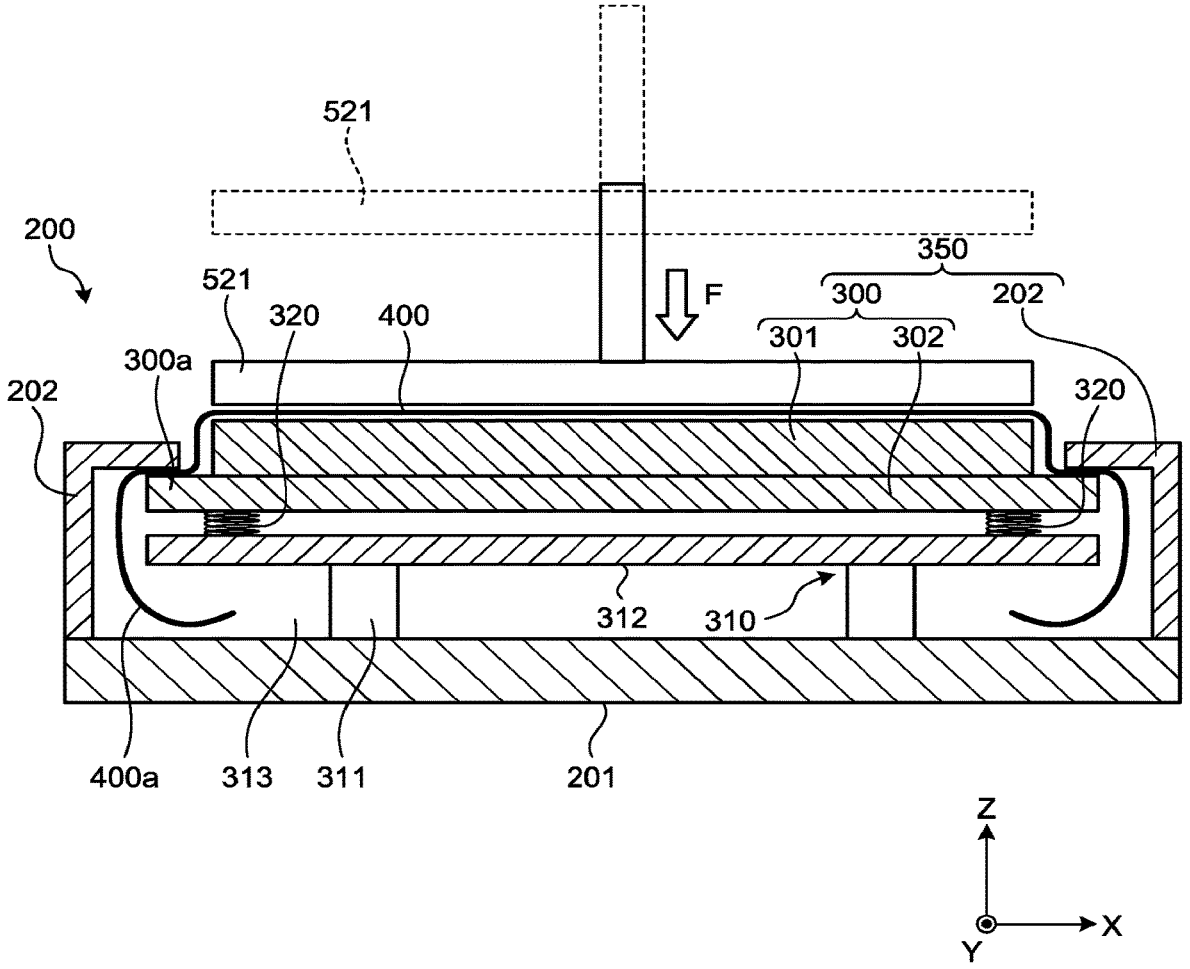
FIG. 13 is a cross-sectional view viewed along the line XIII-XIII in FIG. 12 illustrating one example of the internal configuration of the fixing device when heating in the first embodiment.

Next, one example of the fixing device 5 constituting a part of the device that provides an image on the fabric 400 will be described with reference to FIG. 11 to FIG. 13. FIG. 11 is a perspective view illustrating one example of the appearance configuration of the fixing device 5 and the cassette 200 in the first embodiment. FIG. 12 is a schematic diagram illustrating one example of the internal configuration of the fixing device 5 in the first embodiment. FIG. 13 is a cross-sectional view viewed along the line XIII-XIII in FIG. 12 illustrating one example of the internal configuration of the fixing device when heating in the first embodiment.

The fixing device 5 in the first embodiment is a device that fixes the provided image to the fabric 400 by heating the fabric 400. In a device body 500 of the fixing device 5, a receiving member 501 and a heat press portion 521 are provided. The receiving member 501 is a member on which the above-described cassette 200 is detachably attached.

The heat press portion 521 illustrated is a contact-type heating mechanism that presses the fabric 400 held to the platen member 300 of the cassette 200 while heating. The temperature of the heat press portion 521 during the fixing is preferably 130 degrees or higher and is more preferably 150 degrees or higher. The size of the heat press portion 521 is designed to come in contact with the fabric 400 only within the area of the platen member 300 where the fabric 400 is held (within the area of the heat-insulating member 301).

In the cassette 200 to be attached to such a fixing device 5, it is preferable that the heat-insulating member 301 of the platen member 300 have the heat resistance against the temperature of the heat press portion 521. By forming the surface of the platen member 300 that is brought into contact with the fabric 400 with a heat-insulating material in this way, efficient heating is possible, as the heat that heats the fabric 400 does not escape into the platen structure body 302 and the cassette 200.

On the front face side of the device body 500 of the fixing device 5, an openable cover 502 and an operating unit 504 are provided. The operating unit 504 is provided at a position where it is not possible to operate it if the cover 502 is not closed. The cover 502 illustrated is of a forwardly tilting form, and the operating unit 504 is arranged in the lower portion on the front face of the device body 500. This makes it possible to prevent a situation in which a worker accidentally comes in contact with the operating unit 504 at the time of attaching work of the cassette 200 and the heat press portion 521 is driven.

The mechanism to detachably couple the receiving member 501 and the cassette 200 may be the same as the coupling mechanism of the stage 111 and the cassette 200 in the above-described printing device 1.

When setting the fabric 400 in the fixing device 5, the cover 502 is opened in an arrow E direction as illustrated in FIG. 12, and the cassette 200 that holds the fabric 400 on which the image has been provided is inserted to and held on the receiving member 501 of the fixing device 5 from an arrow D direction indicated in FIG. 11. In this case, the cassette 200 is attached by sliding it with respect to the receiving member 501. Thereafter, the heat press portion 521 is lowered in an arrow F direction as illustrated in FIG. 13, and the heat press portion 521 is pressed to the fabric 400 held to the platen member 300 and heats the fabric 400.

According to the above-described configuration, it is possible to share the cassette 200 that holds the fabric 400 on the printing device 1 and the fixing device 5. This makes it possible to hold the fabric 400 provided with the image in a state of printing as is and to set it to the fixing device 5. As a result, when setting the fabric 400 to the fixing device 5, it is possible to prevent the fabric 400 from being wrinkled and to prevent the printing surface from being entangled as a portion overlaps.

Furthermore, because the platen member 300 that holds the fabric 400 has the heat resistance against the heating by the fixing device 5, it is possible to prevent the occurrence of a failure such as the platen member 300 being deformed due to the heat.

Figure 14:
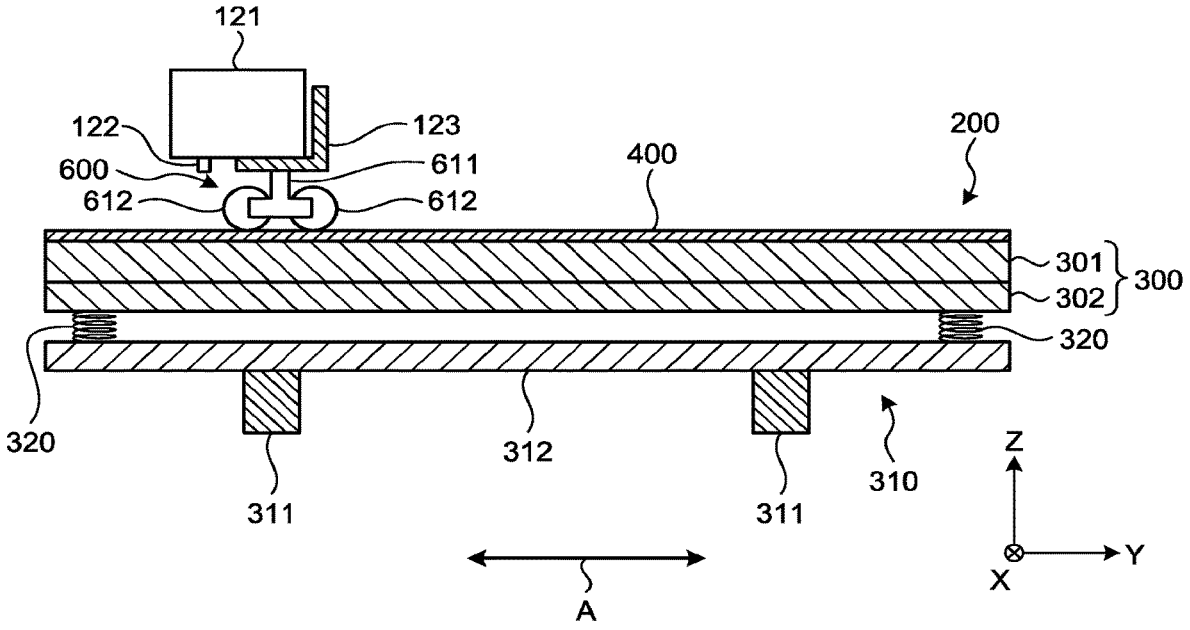
FIG. 14 is a cross-sectional view viewed along the line XIV-XIV in FIG. 2 illustrating one example of the configuration of a contacting portion in the first embodiment.
Figure 15:
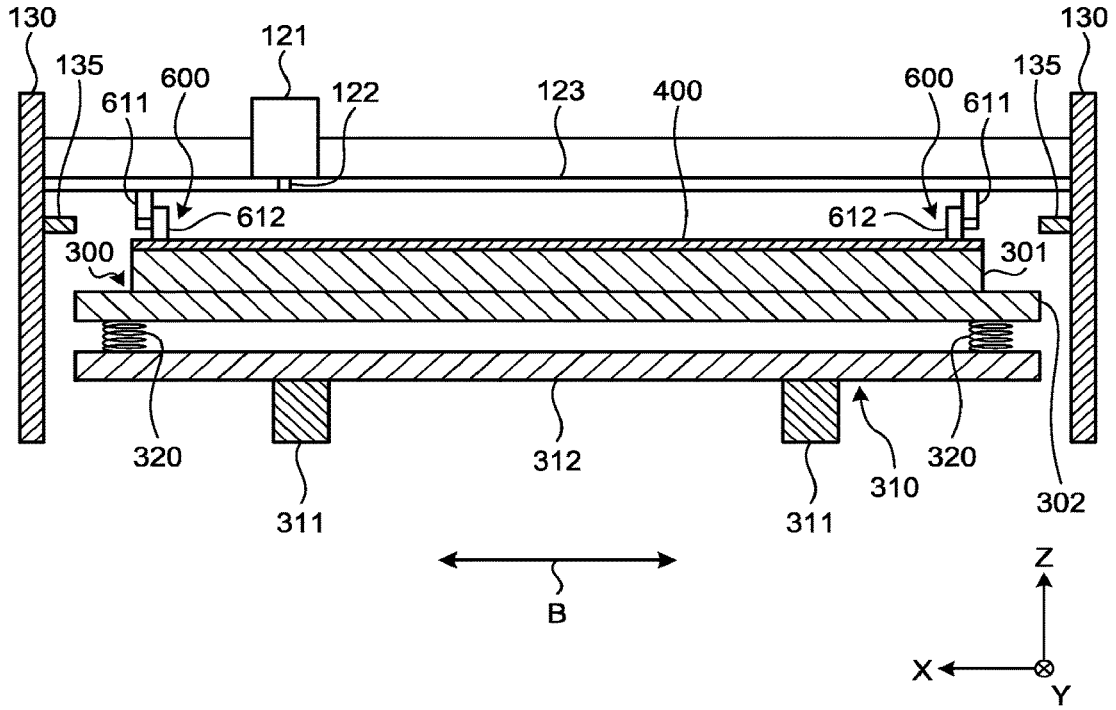
FIG. 15 is a cross-sectional view viewed along the line XV-XV in FIG. 2 illustrating one example of the configuration of the contacting portions in the first embodiment.
Figure 16:
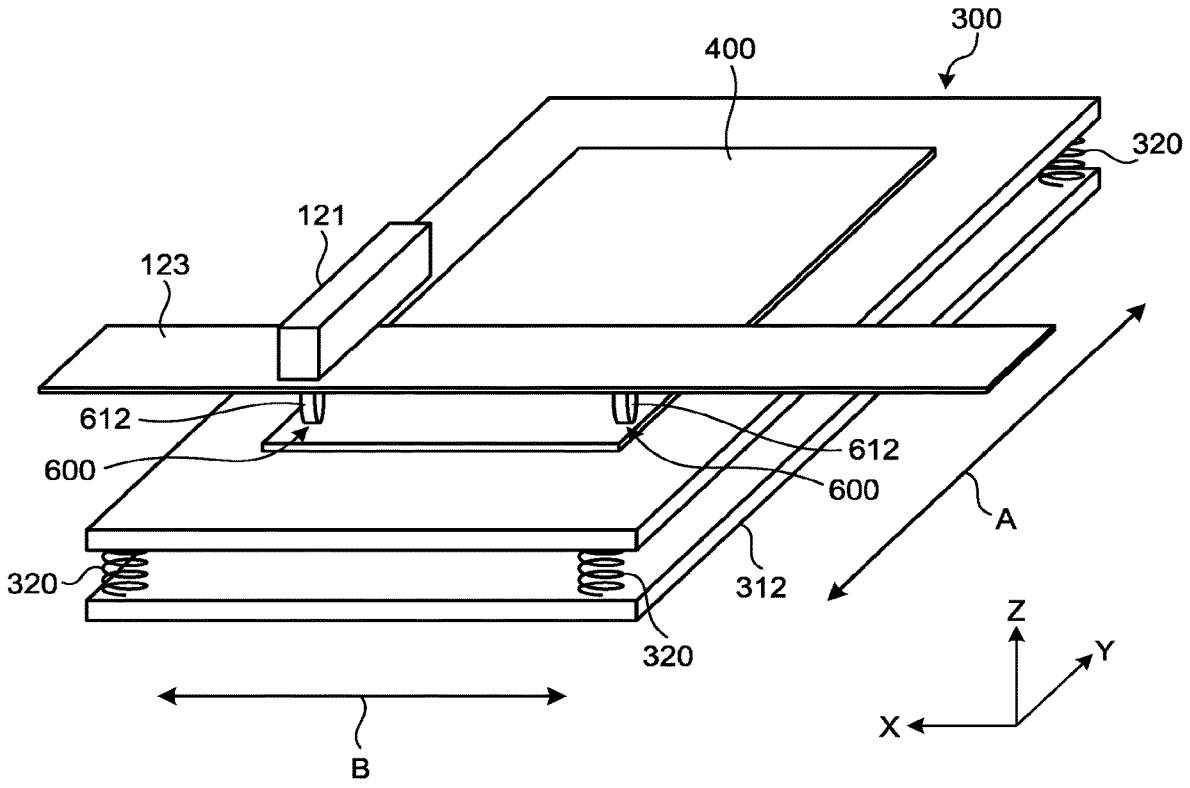
FIG. 16 is a perspective view illustrating one example of the configuration of the contacting portions in the first embodiment.

Next, a configuration for stabilizing a gap formed between the head 122 and the fabric 400 will be described with reference to FIG. 14 to FIG. 16. FIG. 14 is a cross-sectional view viewed along the line XIV-XIV in FIG. 2 illustrating one example of the configuration of a contacting portion 600 in the first embodiment. FIG. 15 is a cross-sectional view viewed along the line XV-XV in FIG. 2 illustrating one example of the configuration of the contacting portions 600 in the first embodiment. FIG. 16 is a perspective view illustrating one example of the configuration of the contacting portions 600 in the first embodiment.

The printing device 1 in the first embodiment includes the contacting portions 600 for maintaining the gap constant. The contacting portions 600 are provided on the guide member 123 and are structure bodies that come in contact with contacted portions located on the upper surface (the surface on which the fabric 400 is placed) side of the platen member 300. The contacting portions 600 are arranged in the vicinities on both ends of the main-scanning direction (the arrow B direction) of the guide member 123. The contacting portion 600 in the first embodiment includes a coupling member 611 and ball bearings 612.

The coupling member 611 is a member that couples the guide member 123 and the ball bearings 612. The coupling member 611 may be secured to the guide member 123 or may be coupled so as to be displaceable in the up-and-down direction by predetermined driving force with respect to the guide member 123.

The ball bearing 612 is a member pivotally supported at the lower end portion of the coupling member 611 and is able to turn along the arrow A direction (the sub-scanning direction). The ball bearing 612 in the first embodiment is in contact with the fabric 400 that is placed or secured on the platen member 300 (the heat-insulating member 301). That is, the fabric 400 that is placed or secured on the platen member 300 is the contacted portion (the surface with which the contacting portions 600 come in contact) located on the upper surface (the surface on which the fabric 400 is placed) side of the platen member 300. The fabric 400 that is the surface that the contacting portions 600 come in contact with is pressed in the Z-axis direction, and the positional relation in the height direction between the fabric 400 and the head 122 is regulated. The ball bearings 612 turn along with the displacement of the platen member 300 along the arrow A direction.

Both end portions of the guide member 123 are fixed to sidewalls 130 that are a part of the housing of the device body 100 or are the members fixed to the relevant housing. On the sidewall 130, sensors 135 that detect the position of the fabric 400 or the platen member 300 in the up-and-down direction are provided. The detection result by the sensors 135 can be used for the height adjustment of the work 312, the length adjustment of the coupling member 611, and the like.

In the case of placing or fixing the fabric 400 that is an object of printing on the platen member 300 in a planar shape as in the first embodiment, variations in the gap may arise along the sub-scanning direction due to slight inclination and distortion of the platen member 300 and the elevating mechanism 310. It is difficult to eliminate such variations in the gap along the sub-scanning direction only by the adjustment of the elevating mechanism 310 on the basis of the detection result of the sensors 135. Thus, in the first embodiment, the contacting portions 600 having the ball bearings 612 turning along the sub-scanning direction are provided, thereby achieving the improvement in the stability of the gap with a simple configuration.

As the ball bearings 612 of the contacting portions 600 come in contact with the fabric 400 that is placed or fixed on the platen member 300, the platen member 300 (the fabric 400) is prevented from coming close to the head 122 excessively. As a result, the gap formed between the head 122 and the fabric 400 (the platen member 300) is maintained constant. At this time, as the ball bearings 612 turn along the sub-scanning direction matching the movement of the platen member 300, it is possible to maintain the contacting state with low frictional resistance over the entire sub-scanning direction. As the springs 320 bias the platen member 300 upward (toward the carriage 121 side), an unnecessary clearance between the platen member 300 and the ball bearings 612 can be prevented from being formed. At this time, as the springs 320 absorb the pressure moderately, the occurrence of an excessive pressure at the contacting points between the platen member 300 and the ball bearings 612 can be prevented. This makes it possible to stabilize the gap over the entire sub-scanning direction without placing a load on the constituent components (the platen member 300, the elevating mechanism 310, the guide member 123, and the like).

In the above description, the configuration in which the springs 320 are interposed between the elevating mechanism 310 and the platen member 300 has been described. However, even when the springs 320 are not provided, the stabilization of the gap can be achieved by the action of the contacting portions 600.

Furthermore, in the above description, an example of using the ball bearing 612 as a member arranged at the distal end of the contacting portion 600 has been described. However, the configuration of the contacting portion 600 is not limited thereto. The member arranged at the distal end of the contacting portion 600 may be a sliding member that is smoothly displaceable to the sub-scanning direction while maintaining the contacting state with the contacted portion (in the first embodiment, the fabric 400 placed or fixed on the platen member 300) located on the upper surface side of the platen member 300. It is preferable that the distal end portion of the sliding member be made of the material and shape for which the frictional resistance is relatively low. In addition, a surface treatment that reduces the frictional resistance may be performed on the distal end portion of the sliding member.

Furthermore, an "adjustment mechanism" that displaces the coupling member 611 of the contacting portion 600 in the up-and-down direction may be provided. The adjustment mechanism can be a mechanism that operates a drive mechanism such as a motor and the like on the basis of the height of the platen member 300 or the fabric 400 detected by the sensors 135 and adjusts the length (the position of the ball bearings 612 in the up-and-down direction) of the coupling member 611, and the like. Having such an adjustment mechanism makes it possible to further improve the stability of the gap.

In the above description, the configuration of fixing an image by contact heating by the heat press portion 521 has been illustrated. However, the fixing method is not limited thereto. For example, it may be a configuration in which the fabric 400 is heated in a non-contact manner. Specifically, it may be a configuration in which, by providing a plate-like heater at a close location to an extent of 2 to 3 mm from the surface of the fabric 400, the surface of the fabric 400 is radiatively heated, or the like.

In the above description, the configuration of sharing the cassette 200 by the printing device 1 and the fixing device 5 has been illustrated, but the embodiments are not limited thereto. For example, for the purpose of suppressing the fuzz of the fabric 400, preprocessing of hot pressing the surface of the fabric 400 may be performed before printing. In such a case, the cassette 200 may be shared by a preprocessing device and the printing device 1. In addition, the processing in each of the preprocessing device, the printing device 1, and the fixing device 5 may be performed by consistently using the same cassette 200.

Furthermore, by arranging the printing device 1 and the other devices such as the fixing device 5 and the like side by side, continuous processing may be performed by sharing the cassette 200 among those devices. Sharing the cassette 200 makes it possible to automate the linkage among the devices. By achieving downsizing using the cassette 200, it is also possible to provide the printing device 1 and the other devices integrally in a single housing.

The shape of the cassette 200 is not limited to the above-described box-like shape, and it may be in any shape as long as the cassette 200 has a configuration capable of being detachably attached to the printing device 1 and the fixing device 5. For example, the cassette 200 may be a single plate-like platen member that can be inserted to both of the printing device 1 and the fixing device 5.

By utilizing the cassette 200 to which the fabric 400 (a T-shirt and the like) is held in advance, it is possible to eliminate the work in which the worker holds the fabric 400 to the cassette 200 each time when printing. In this case, the cassette 200 is recovered after use, and the new fabric 400 is held for the subsequent printing. This makes it possible to improve the workability.

In addition, the platen member 300 on which the fabric 400 is held in advance and that can be detachably attached to the cassette 200 may be used. In this case, when printing, it only needs to attach the relevant platen member 300 to the cassette 200 as is and perform the printing. Then, after completion of the printing and fixing, it only needs to remove the platen member 300 from the cassette 200 and, when performing the subsequent printing, to the cassette 200, attach the platen member 300 on which another fabric 400 has been held already. Even with such a configuration, the workability can be improved. This makes it unnecessary for the worker to prepare the fabric 400 each time, thereby facilitating the continuous processing of a plurality of pieces and also enabling the continuous processing of a plurality of pieces to be automated.

In the above description, the case of using the fabric 400 as a medium has been described. However, the type of medium is not particularly limited. For example, the medium only needs to be a medium on which an object such as ink can adhere at least temporarily, and it can be printing paper (including plain paper, glossy paper, special paper), plastic films, overhead projector (OHP) sheets, and the like.

As in the foregoing, according to the first embodiment, it is possible to improve the stability of the gap.

The following describes other embodiments with reference to the accompanying drawings, but the portions having identical or similar actions and/or effects to those in the first embodiment may be denoted by the identical reference signs and their explanations may be omitted.

Second Embodiment

A second embodiment is different from the first embodiment in that the contacted portion with which the ball bearings 612 of the contacting portions 600 come in contact is not the fabric 400 but the platen member 300.

Figure 17:
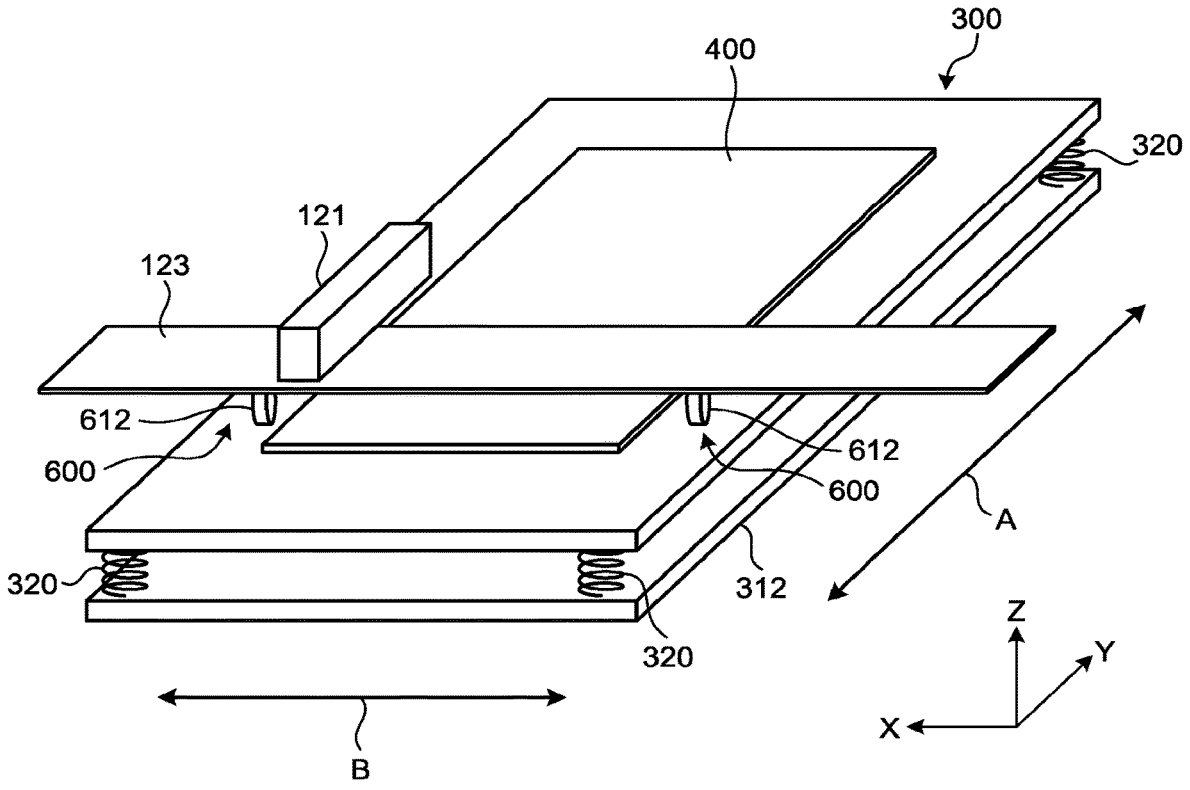
FIG. 17 is a perspective view illustrating one example of the configuration of contacting portions according to a second embodiment.

FIG. 17 is a perspective view illustrating one example of the configuration of the contacting portions 600 according to the second embodiment. The ball bearings 612 of the contacting portions 600 in the second embodiment are in contact with the upper surface of the platen member 300. That is, the platen member 300 is the contacted portion (the surface with which the contacting portions 600 come in contact) located on the upper surface (the surface on which the fabric 400 is placed) side of the platen member 300. The platen member 300 that is the surface that the contacting portions 600 come in contact with is pressed in the Z-axis direction, and the positional relation in the height direction between the fabric 400 and the head 122 is regulated.

In such a configuration, the gap formed between the head 122 and the fabric 400 can be adjusted more accurately.

Third Embodiment

A third embodiment is different from the first embodiment in that the contacted portion with which the ball bearings 612 of the contacting portions 600 come in contact is the outer peripheral cover 202.

Figure 18:
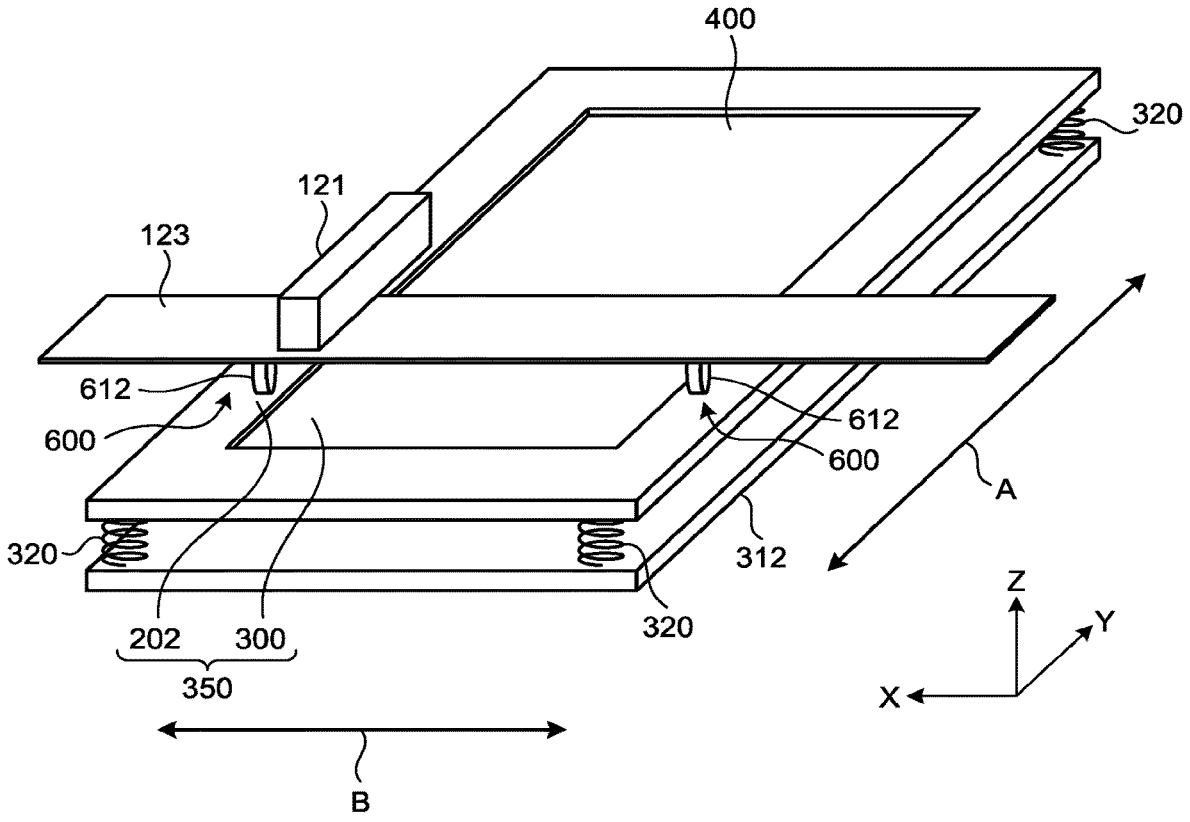
FIG. 18 is a perspective view illustrating one example of the configuration of contacting portions according to a third embodiment.

FIG. 18 is a perspective view illustrating one example of the configuration of the contacting portions 600 in the third embodiment. The ball bearings 612 of the contacting portions 600 in the third embodiment are in contact with the outer peripheral cover 202 that fixes the fabric 400 by the outer peripheral portion of the platen member 300. That is, the outer peripheral cover 202 is the contacted portion (the surface with which the contacting portions 600 come in contact) located on the upper surface (the surface on which the fabric 400 is placed) side of the platen member 300. The outer peripheral cover 202 that is the surface that the contacting portions 600 come in contact with is pressed in the Z-axis direction, and the positional relation in the height direction between the fabric 400 and the head 122 is regulated.

In such a configuration, without directly exerting the pressure from the contacting portions 600 on the fabric 400, the gap can be accurately adjusted.

Fourth Embodiment

A fourth embodiment is different from the second embodiment in that a line head system is employed as a discharge mechanism that discharges ink and the like.

Figure 19:
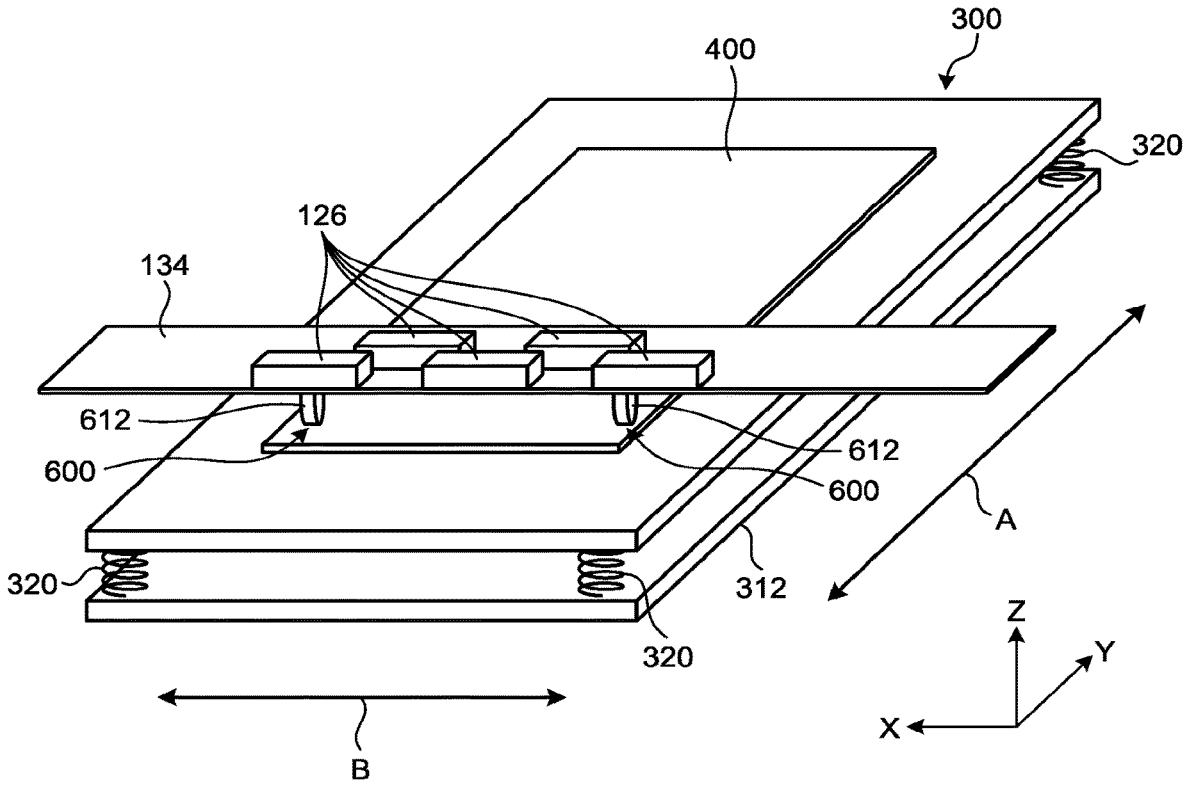
FIG. 19 is a perspective view illustrating one example of a discharge mechanism according to a fourth embodiment.

FIG. 19 is a perspective view illustrating one example of the discharge mechanism according to the fourth embodiment. The printing device 1 in the fourth embodiment includes a head group 126 and a head holding member 134.

The head group 126 is a line head made up of a plurality of heads arranged along the arrow B direction orthogonal to the arrow A direction in which the platen member 300 moves. The head group 126 is one example of a "discharge unit" that discharges ink and the like to the fabric 400. The head holding member 134 is a member that is fixed to the sidewall 130 (see FIG. 15) and the like of the device body 100 and is arranged along the arrow B direction having a size of covering the width of the fabric 400 in the longitudinal direction. The head holding member 134 is one example of a "holding portion" that holds the head group 126 that is integrated to a size covering the width of the fabric 400. With such a configuration, because only the platen member 300 moves in the arrow A direction, printing can be performed on the fabric 400 on the platen member 300 by displacing the relative position of the fabric 400 and the head group 126, without having a displacement mechanism that is displaced in the main-scanning direction such as the carriage 121.

The contacting portions 600 in the fourth embodiment are fixed to the head holding member 134, and as with the second embodiment, are configured such that the ball bearings 612 come in contact with the fabric 400. The contacting place (the contacted portion) of the ball bearing 612 may be the upper surface of the platen member 300 as in the first embodiment or may be the outer peripheral cover 202 as in the third embodiment.

As in the above description, even with a configuration that employs a line head system, the stability of the gap can be improved.

Fifth Embodiment

A fifth embodiment is different from the other embodiments in that the platen member on which a medium is placed or fixed is integrated with a device body.

Figure 20:
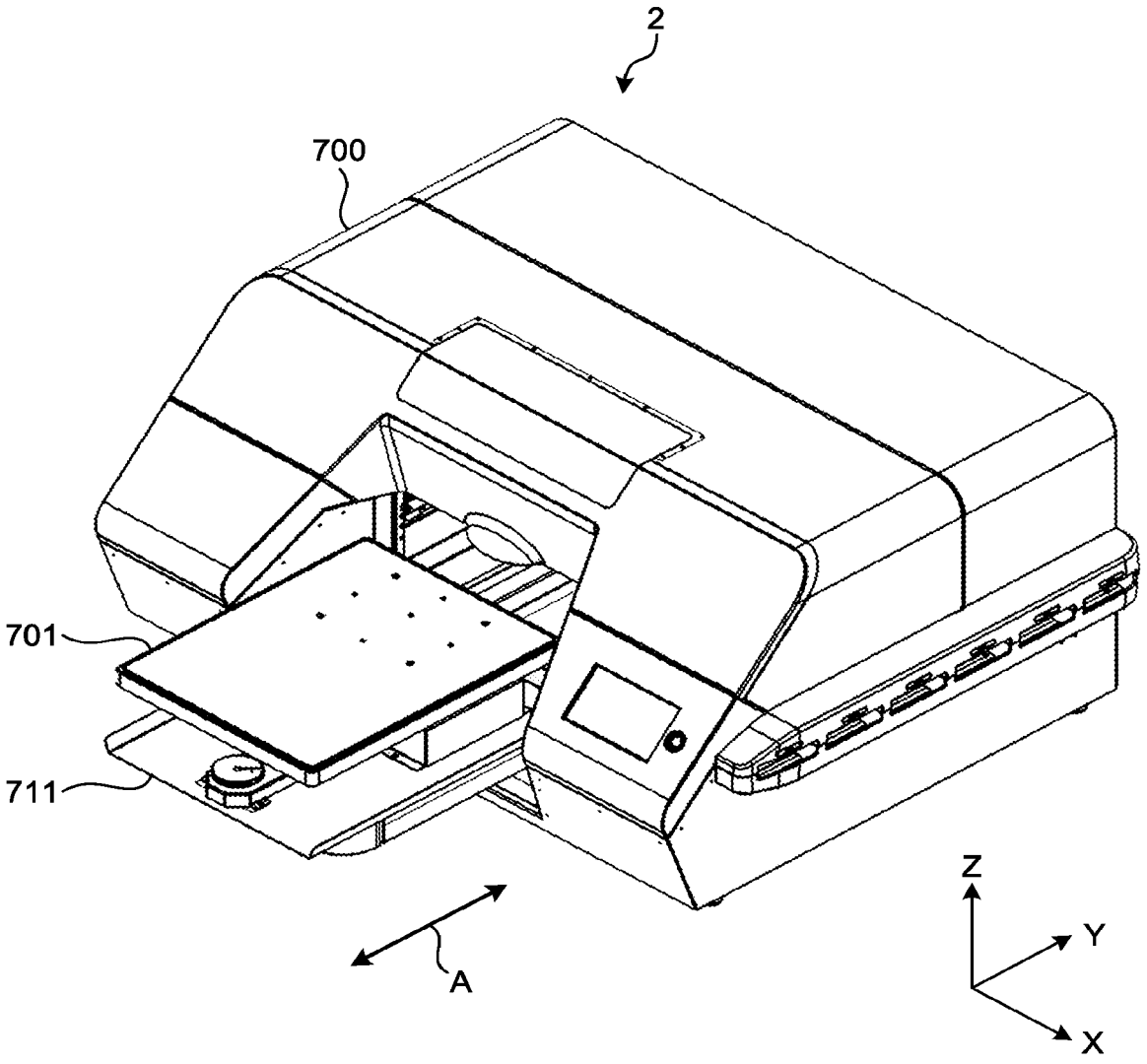
FIG. 20 is a perspective view illustrating one example of the appearance configuration of a printing device according to a fifth embodiment.
Figure 21:
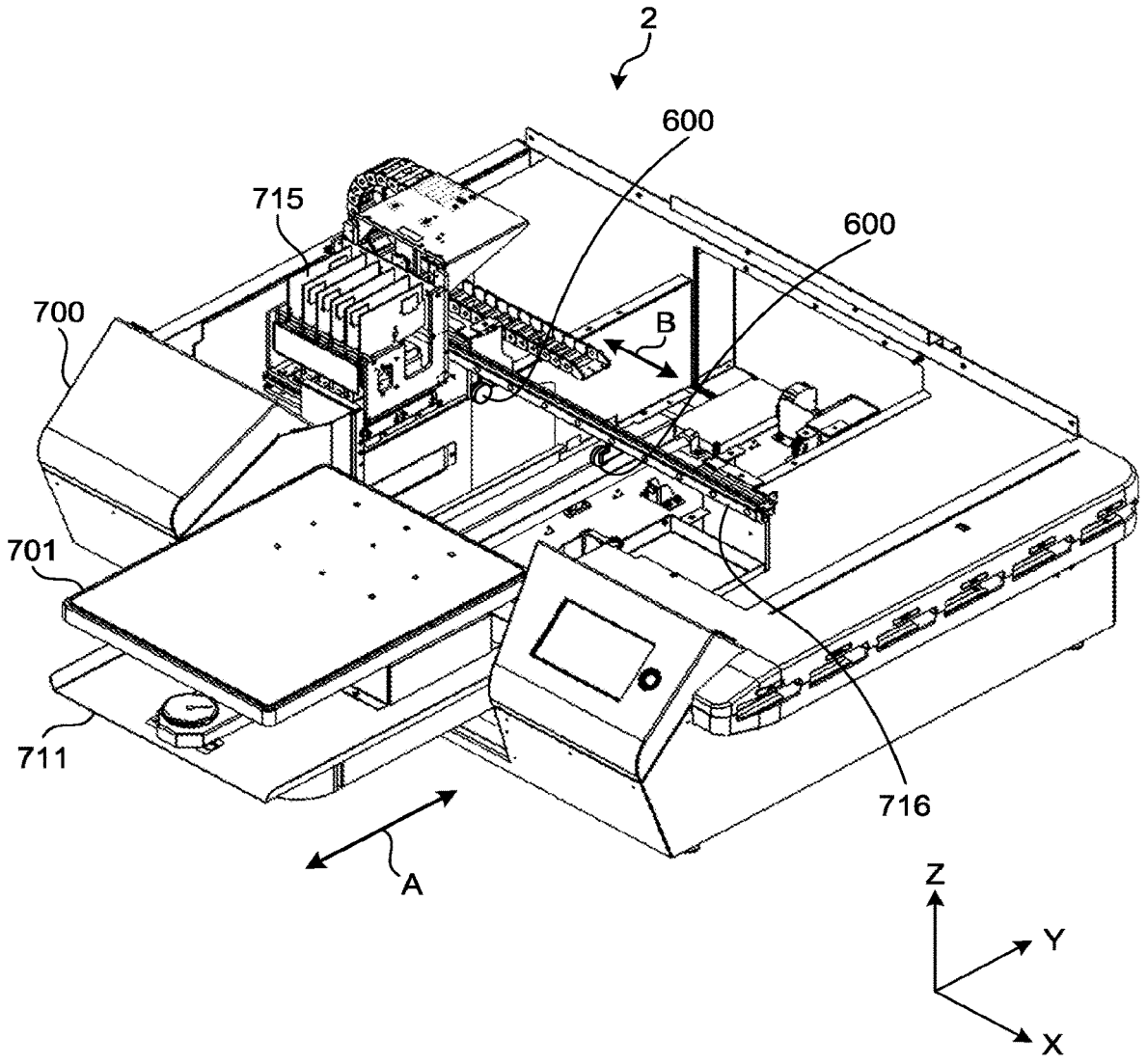
FIG. 21 is a perspective view illustrating one example of the internal configuration of the printing device in the fifth embodiment.

FIG. 20 is a perspective view illustrating one example of the appearance configuration of a printing device 2 according to the fifth embodiment. FIG. 21 is a perspective view illustrating one example of the internal configuration of the printing device 2 in the fifth embodiment.

A platen member 701 in the fifth embodiment is fixed onto a stage 711 that is displaced in the sub-scanning direction (the arrow A direction). In the inside of the relevant platen member 701, the elevating mechanism 310 and the springs 320 as illustrated in the first embodiment are provided. On a guide member 716 that holds a carriage 715 to be slidable along the main-scanning direction (the arrow B direction), the contacting portions 600 illustrated in the first to the fourth embodiments are provided.

At the time of performing printing in the printing device 2 having the above-described configuration, the stage 711 is displaced first so as to expose the entire platen member 701 on the outside of a device body 700. Thereafter, as the worker sets a medium to the exposed platen member 701, the stage 711 is displaced so as to pull the platen member 701 into the device body 700. Then, in the device body 700, as with the above-described other embodiments, the printing is performed in a state in which the gap is stabilized due to the action of the contacting portions 600 and the springs 320.

As just described, even in the case in which the platen member 701 is integrally configured with the device body 700, the effect of stabilizing the gap can be obtained.

According to an embodiment, it is possible to improve the stability of the gap.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A printing device, comprising:

a medium holding portion on which a medium is placed;

a discharge unit configured to discharge an object to the medium placed on the medium holding portion;

a holding portion configured to hold the discharge unit;

a first displacement mechanism configured to change a relative position of the medium and the discharge unit in a subscanning direction along a placement surface of the medium;

a second displacement mechanism configured to displace the medium holding portion along a height direction; and a contacting portion on the holding portion, the contacting portion configured to come in contact with a contacted portion located on a surface of the medium holding portion to regulate a distance between the medium and the discharge unit by the contact, the medium being placed on the surface of the medium holding portion, wherein the contacting portion includes a contacting member configured to move when the relative position of the medium and the discharge unit in the subscanning direction changes.

2. The printing device according to claim 1, further comprising an elasticity portion configured to bias the medium holding portion toward the contacting portion.

3. The printing device according to claim 1, wherein the contacting member is a ball bearing configured to turn along the subscanning direction in which the relative position of the medium and the discharge unit changes.

4. The printing device according to claim 1, wherein the contacting member is a sliding member configured to slide along the subscanning direction in which the relative position of the medium and the discharge unit changes.

5. The printing device according to claim 1, wherein the medium holding portion includes a placement portion on which the medium is to be placed, and the contacted portion includes a surface of the placement portion, the medium to be placed on the surface of the placement portion.

6. The printing device according to claim 1, wherein the medium holding portion includes a placement portion on which the medium is to be placed, and the contacted portion includes the medium placed on the placement portion.

7. The printing device according to claim 1, wherein the medium holding portion includes a placement portion on which the medium is placed, and a fixing portion configured to fix the medium at an outer peripheral portion of the placement portion, and the contacted portion includes the fixing portion.

8. The printing device according to claim 2, wherein the second displacement mechanism includes an elevating portion on another surface of the medium holding portion, the another surface being opposite to the surface of the medium holding portion on which the medium is placed, the elevating portion configured to be displaced along a height direction by receiving driving force, and the elasticity portion is interposed between the elevating portion and the medium holding portion.

9. The printing device according to claim 1, further comprising:

a detector configured to detect a position of the medium holding portion or a position of the medium in a height direction; and an adjustment mechanism configured to adjust, based on a detection result by the detector, a position of the contacting portion in the height direction.

10. The printing device according to claim 1, wherein the first displacement mechanism includes a coupling mechanism configured to detachably couple with the medium holding portion.

11. The printing device according to claim 1, wherein the discharge unit is configured to discharge an object capable of textile printing to the medium.

12. The printing device of claim 1, wherein the contacting member is configured to move when the medium moves relative to the discharging unit.

13. The printing device of claim 1, wherein the holding portion includes a guide member movably holding the discharge unit.

14. The printing device of claim 1, wherein the contacting portion includes a contacting member configured to move when the relative position of the medium holding portion and the discharge unit in the subscanning direction changes.

* * * * *